US005536093A

United States Patent [19]

Tomoda et al.

[11] Patent Number: 5,536,093

[45] Date of Patent: Jul. 16, 1996

[54] SUPPLY AND TAKE-UP REELS IN AN INK SHEET CARTRIDGE AND RECORDING APPARATUS USING SAID INK SHEET CARTRIDGE

[75] Inventors: Akihiro Tomoda, Yokohama; Yasushi Ishida; Takashi Awai, both of Tokyo; Minoru Yokoyama; Masakatsu Yamada, both of Yokohama; Takehiro Yoshida, Tokyo; Makoto Kobayashi, Tama; Tomoyuki Takeda, Yokohama; Takeshi Ono, Kawasaki; Masaya Kondo, Tokyo, all of Japan

[73] Assignee: Canon Kabushiki Kaisha, Tokyo, Japan

[21] Appl. No.: 375,170

[22] Filed: Jan. 18, 1995

Related U.S. Application Data

[63] Continuation of Ser. No. 218,302, Mar. 28, 1994, abandoned, which is a continuation of Ser. No. 100,208, Aug. 2, 1993, abandoned, which is a continuation of Ser. No. 728,345, Jul. 11, 1991, abandoned.

[30] Foreign Application Priority Data

Jul. 13, 1990 [JP] Japan ..... 2-184120

[51] Int. Cl.[6] ..... B41J 33/00; B65H 75/00

[52] U.S. Cl. ..... 400/242; 400/246; 242/610

[58] Field of Search ..... 400/207, 208, 400/242, 246, 613, 614; 242/610, 610.1, 610.2, 610.3, 610.4, 610.5, 610.6, 613, 129, 118, 129.5, 129.51

[56] References Cited

U.S. PATENT DOCUMENTS

| | | | |
|---|---|---|---|
| 4,034,933 | 7/1977 | Hara et al. | 242/129.8 |
| 4,254,919 | 3/1981 | Moodie | 242/610.6 |
| 4,531,135 | 7/1985 | Toshima | 346/76 PH |
| 4,558,963 | 12/1985 | Applegate et al. | 400/232 |
| 4,874,139 | 10/1989 | Kewin | 242/610.4 |
| 4,892,425 | 1/1990 | Shimizu et al. | 400/246 |
| 4,924,242 | 5/1990 | Fukawa | 400/246 |
| 5,056,940 | 10/1991 | Basile | 400/208 |
| 5,085,531 | 2/1992 | Gillio | 400/208 |

FOREIGN PATENT DOCUMENTS

| | | | |
|---|---|---|---|
| 0366368 | 5/1990 | European Pat. Off. . | |
| 3241847 | 5/1984 | Germany | 400/242 |
| 60-018374 | 1/1985 | Japan . | |
| 31270 | 2/1986 | Japan | 400/120 MP |
| 61-122981 | 6/1986 | Japan . | |
| 62-181168 | 8/1987 | Japan . | |
| 2171082 | 8/1986 | United Kingdom . | |

*Primary Examiner*—David A. Wiecking
*Attorney, Agent, or Firm*—Fitzpatrick, Cella, Harper & Scinto

[57] ABSTRACT

An ink sheet cartridge mountable onto a recording apparatus comprises a supply reel around which an ink sheet is wound, a take-up reel for winding the ink sheet supplied from the supply reel, and a frame body for holding the supply reel and the take-up reel, wherein the strength of the take-up reel is made greater than that of the supply reel.

45 Claims, 24 Drawing Sheets

SUPPLY AND TAKE-UP REELS IN AN INK SHEET CARTRIDGE AND RECORDING APPARATUS USING SAID INK SHEET CARTRIDGE

This application is a continuation of application Ser. No. 08/218,302 filed Mar. 28, 1994, now abandoned, which is a continuation of application Ser. No. 08/100,208 filed Aug. 2, 1993, now abandoned, which is a continuation of application Ser. No. 07/728,345 filed Jul. 11, 1991, now abandoned.

BACKGROUND OF THE INVENTION

1. Field of the Invention

The present invention relates to an ink sheet cartridge and a recording apparatus using said ink sheet cartridge.

2. Related Background Art

Today, along with the progress of information processing systems, various information processing equipments have been developed. Among these equipments, the recording apparatus such as a facsimile terminal equipment or printer has been used extensively not only in offices, but also in homes.

In connection with these facsimile terminal equipments, the so-called thermal recording method is generally used in which the thermosensible sheet coloring with the application of heat is used to facilitate the miniaturization, but recently, the facsimile terminal equipment with the so-called thermal transfer recording method using the ink sheet has been also developed. In the facsimile terminal equipment with the thermal transfer recording method, there are advantages that the plain paper can be used as a recording sheet, and images can be clearly recorded.

And such a facsimile terminal equipment has a structure of opening an upper cover (recording cover) of main body by turning it upward for easy exchange of the ink sheet, in which the upper cover has an ink sheet cassette with the ink sheet contained therein. A driving mechanism for driving a take-up reel shaft within the ink sheet cartridge is mounted on the upper cover, as the cartridge previously described, to simplify the structure. And in view of the weight of the driving mechanism, the take-up reel shaft is located closer to a rotation shaft around which the upper cover is turned than a supply reel shaft.

However, as the ink sheet is very thin, it may easily produce wrinkles. Thus, in order to load the ink sheet into a recording apparatus without producing wrinkles of the ink sheet, a simple method for loading has been proposed in which the ink sheet is contained within an ink sheet cartridge, which is then loaded into the recording apparatus.

However, as a large tension is applied to the take-up reel in winding up the ink sheet, the take-up reel may sometimes be flexed.

For example, in the so-called multi-print method which performs the recording by providing a difference between the conveying speed of recording sheet and that of ink sheet, the rotational force is transmitted to a reel gear integral with the take-up reel, thereby rotating the take-up reel to wind the ink sheet around the reel, whereby the take-up tension is very large.

Furthermore, the ink sheet between a platen roller and the take-up reel shaft may receive the heat from a recording head, as well as losing the ink on an ink layer of a recording portion in the ink sheet. Such ink sheet is likely to produce some wrinkles, so that the take-up reel shaft must be subjected to a large force to wind the ink sheet without wrinkles.

Therefore, there was a problem that if the strength of the take-up reel shaft was weak, the take-up reel shaft might be flexed, causing some irregular conveyances of the ink sheet, and disordering recorded images.

On the other hand, a tension from the ink sheet is also exerted on the side of a supply reel shaft. But as the material for use with such an apparatus has generally a property that when its strength increases, the weight also increases, there was a problem in that a reel shaft having the same strength as the take-up reel shaft is directly used for the supply reel shaft which is located further away from the rotation shaft as compared with the take-up reel shaft.

SUMMARY OF THE INVENTION

An object of the present invention is to provide a recording apparatus in which the strengths of a take-up reel and a supply reel within an ink sheet cartridge are made optimum, in order to resolve the conventional art problems as previously described.

Another object of the present invention is to provide an ink sheet cartridge and a recording apparatus using said ink sheet cartridge, the ink sheet cartridge being mountable on the recording apparatus, characterized by comprising a supply reel around which an ink sheet is wound, a take-up reel for winding said ink sheet supplied from said supply reel, and a frame body for holding said supply reel and said take-up reel, wherein the strength of said take-up reel is made greater than that of said supply reel.

Another object of the present invention is to provide an ink sheet cartridge and a recording apparatus using said ink sheet cartridge, the ink sheet cartridge being mountable on the recording apparatus, characterized by comprising a supply reel around which an ink sheet is wound, a take-up reel for winding said ink sheet supplied from said supply reel, and a frame body for holding said supply reel and said take-up reel, wherein the strength of said take-up reel is made greater than that of said supply reel, and said supply reel is made lighter than said take-up reel.

BRIEF DESCRIPTION OF THE DRAWINGS

FIG. 26 is a flowchart showing a detection procedure for ink sheet size and so on.

DETAILED DESCRIPTION OF THE PREFERRED EMBODIMENTS

An example of a recording apparatus according to the present invention will be described in the following.

Figure 1:
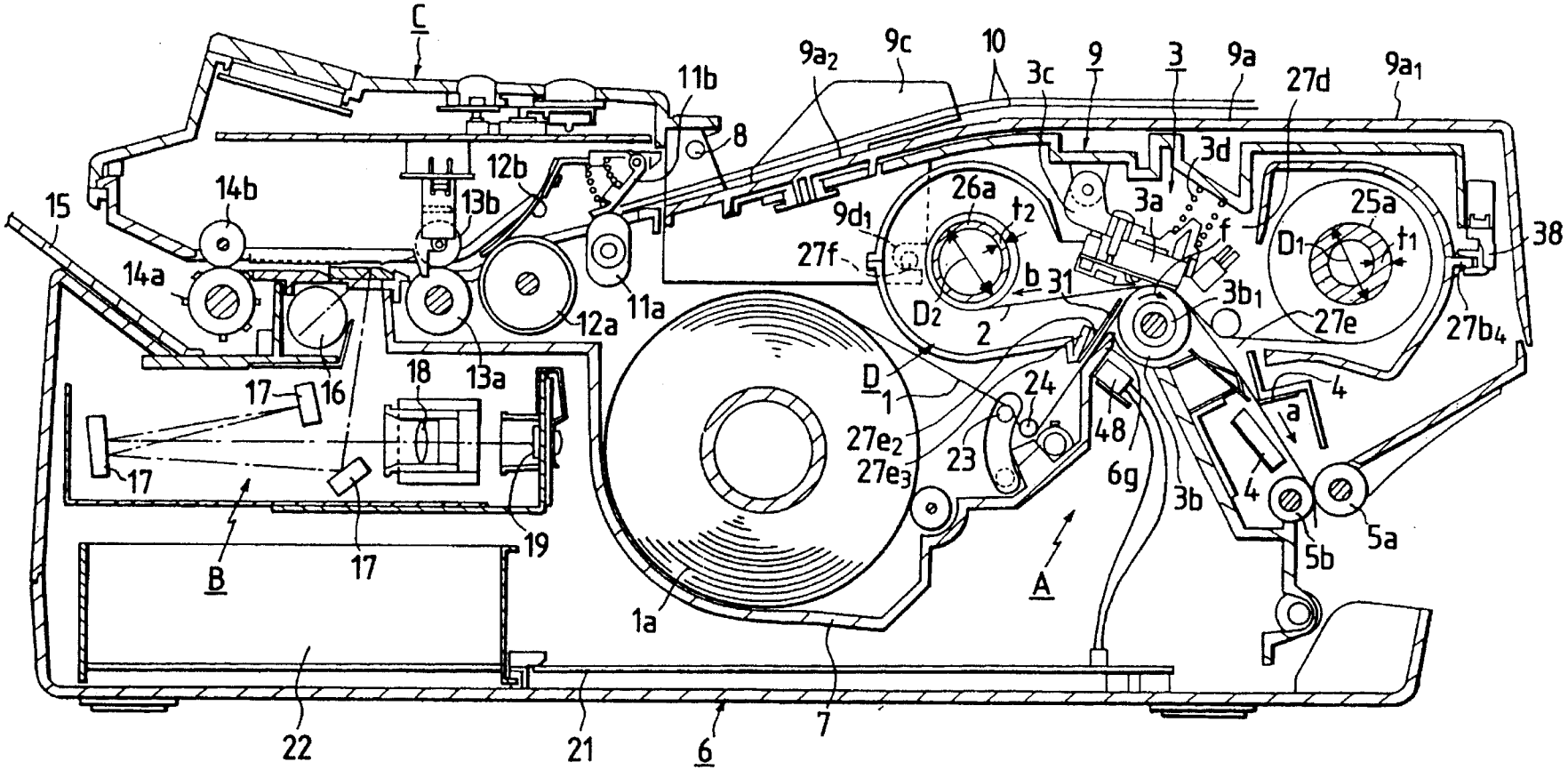
FIG. 1 is a constitutional explanation view of a facsimile terminal equipment to which an example of the present invention is applied.
Figure 2:
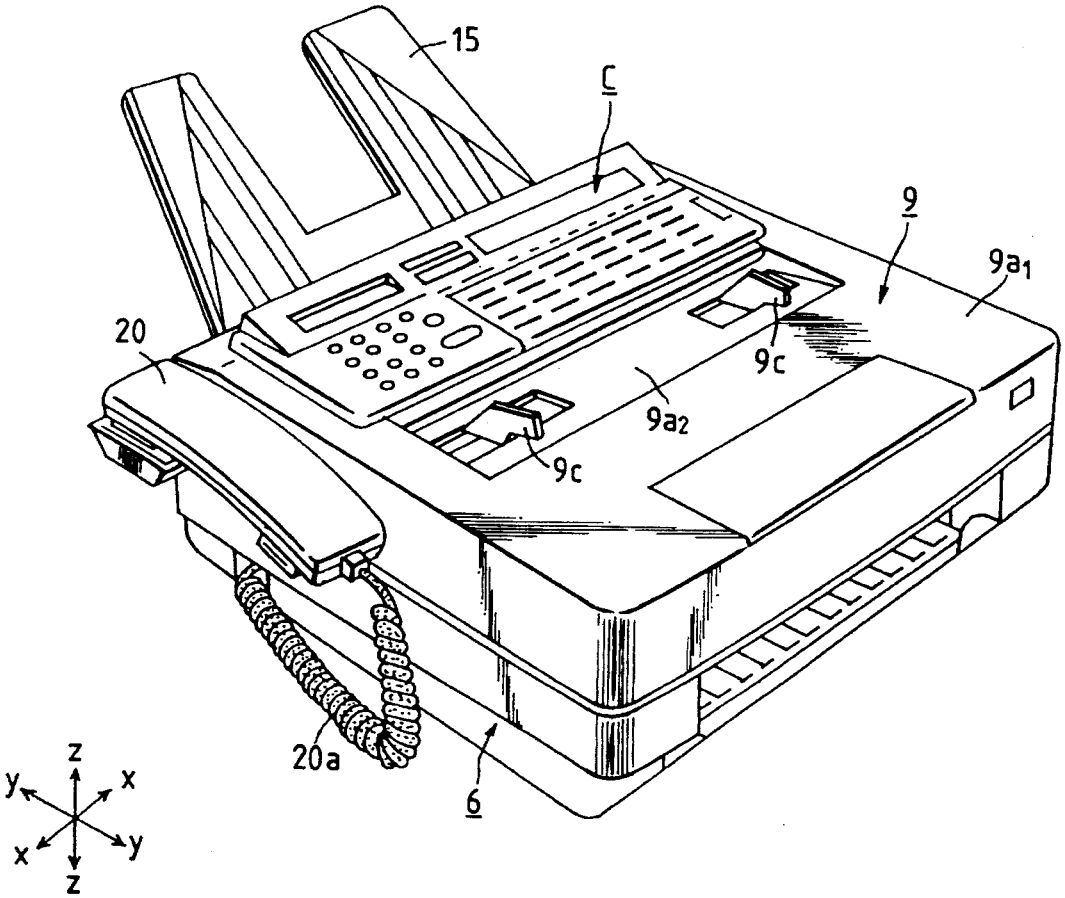
FIG. 2 is an external explanation view of a facsimile terminal equipment.
Figure 3:
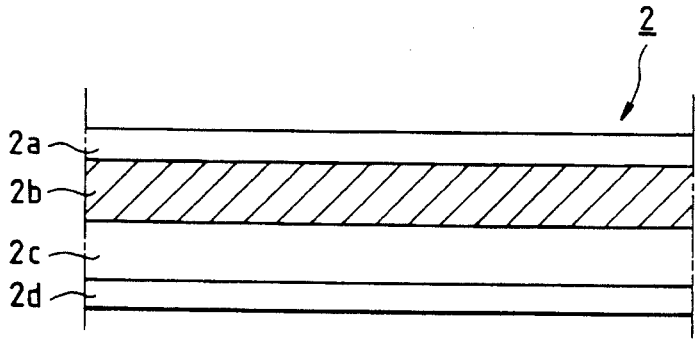
FIG. 3 is a cross-sectional explanation view of an ink sheet.
Figure 4:
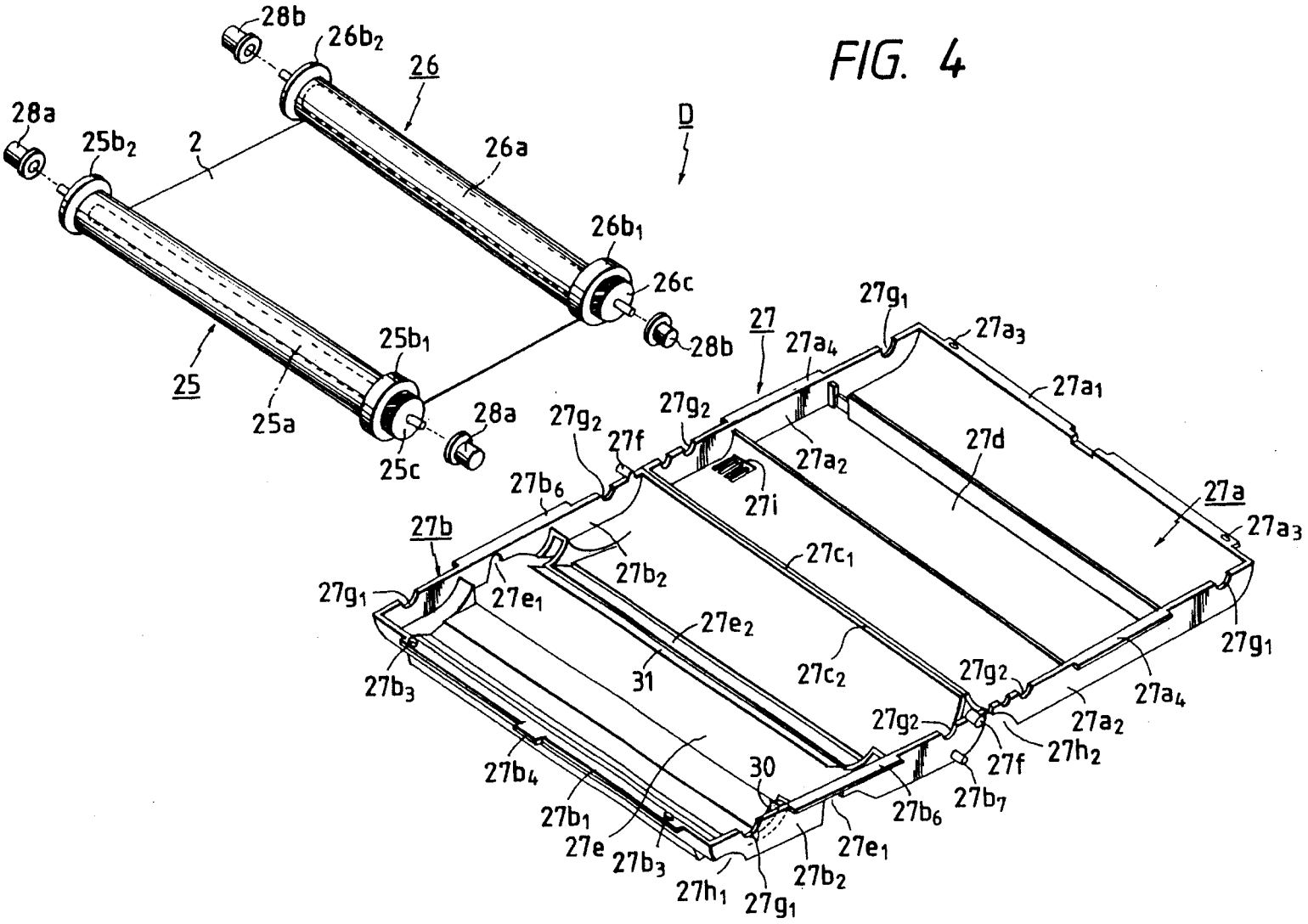
FIG. 4 is an expanded explanation view of an ink sheet cartridge.
Figure 5:
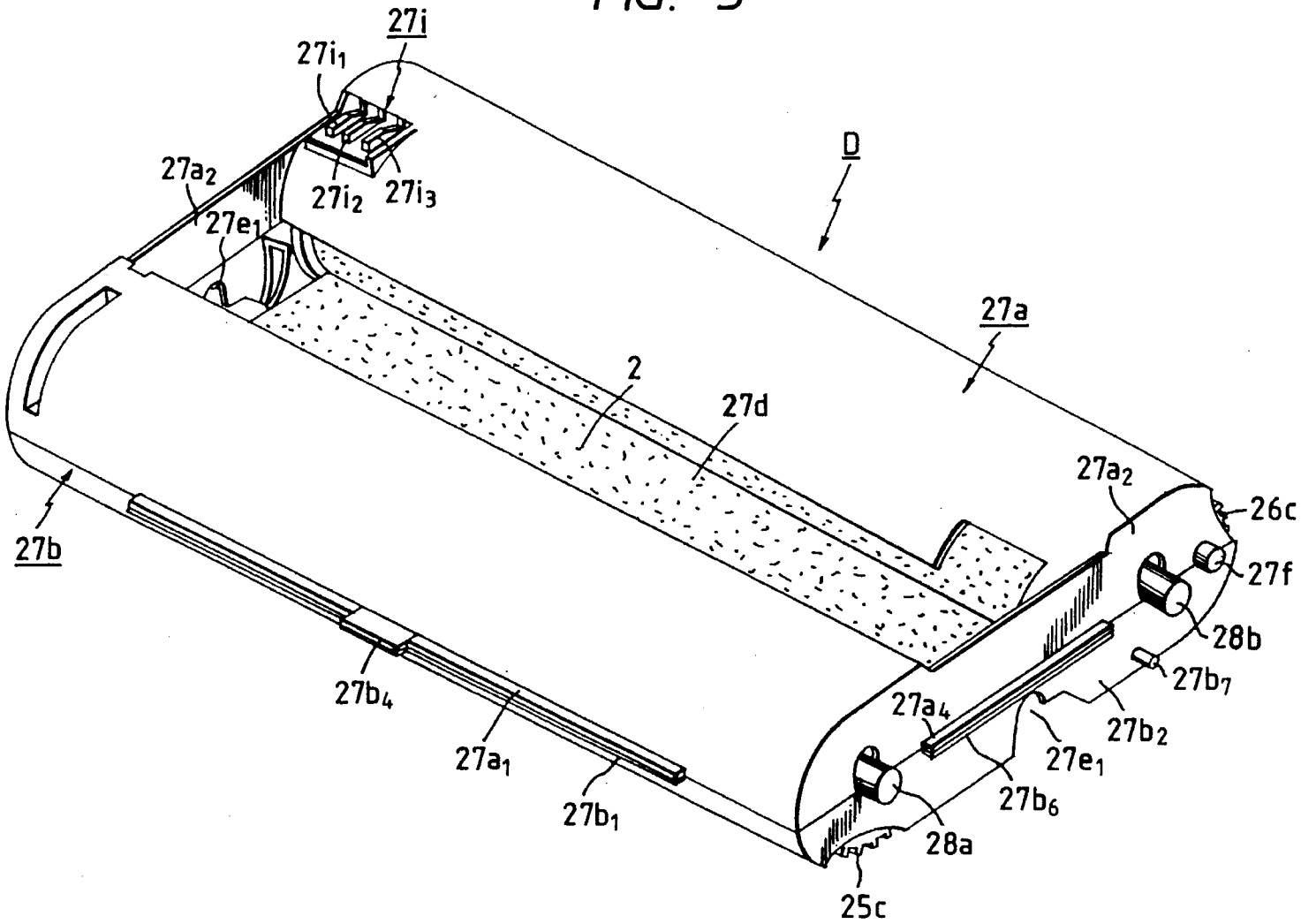
FIGS. 5 and 6 are perspective explanation views of the ink sheet cartridge.
Figure 6:
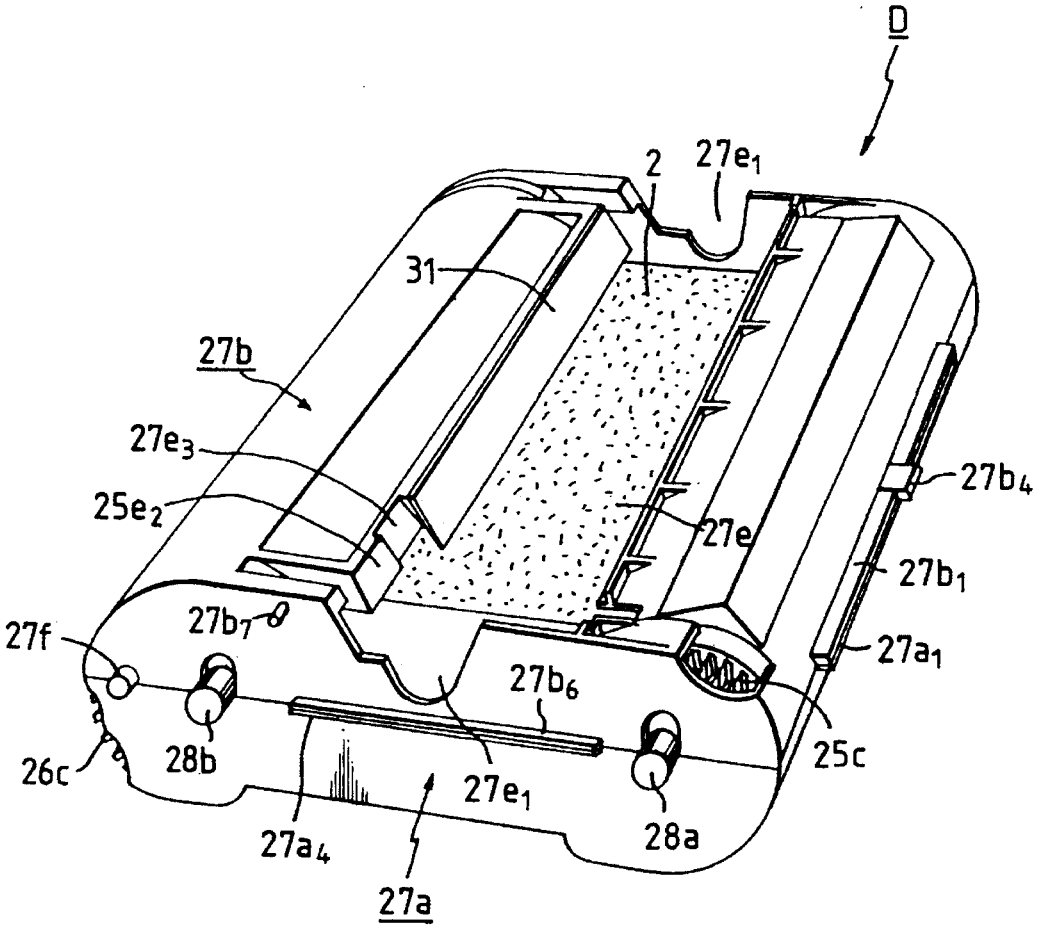
Figure 7A:
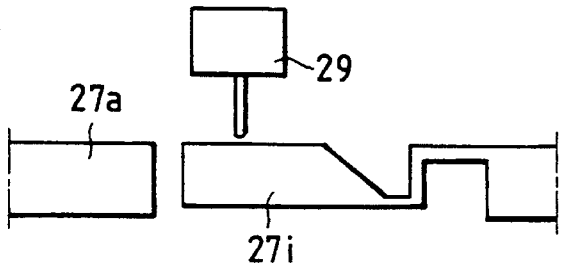
FIGS. 7A and 7B are explanation views of the relations between an identification piece and a microswitch.
Figure 7B:
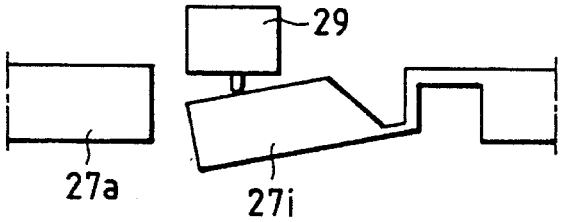

A recording apparatus A in this example is constituted as recording system for a facsimile terminal equipment, wherein FIG. 1 is an explanation view of total construction for the facsimile terminal equipment, FIG. 2 is an external perspective explanation view, FIG. 3 is a cross-sectional explanation view of an ink sheet, FIG. 4 is an expanded explanation view of an ink sheet cartridge, and FIGS. 5 and 6 are external perspective explanation views of the ink sheet cartridge.

General Description of Facsimile Terminal Equipment

Firstly, the total constitution of facsimile terminal equipment will be described with reference to FIGS. 1 and 2. Note that as shown in FIG. 2, the direction of arrow x is defined as the left and right directions of the equipment, the direction of arrow y is defined as the forward and backward directions, and the direction of arrow z is defined as the upper and lower directions.

This facsimile terminal equipment is constituted of a recording system A as a recording apparatus, a reading system B for reading an image represented in an original, an operation panel C, and an ink sheet cartridge D loaded therein, as shown in FIG. 1.

The recording system A records image onto a recording sheet 1, in accordance with an image signal transmitted from other terminals, or from the reading system B as will be described later. This is, with a recording sheet 1 and an ink sheet 2 overlapped being pressed against a platen roller 3*b* by a recording head 3*a* constituting recording means 3, the recording sheet 1 is conveyed in a direction of arrow a with the rotation of the platen roller 3*b* in a direction of arrow as indicated in FIG. 1, while the ink sheet 2 is conveyed in a direction of arrow b by driving means as will be described later. An image is formed by heating the recording head 3*a* in accordance with the image signal and in synchronism with the conveyance of the recording sheet 1 and the ink sheet 2, thereby fusing the ink applied on the ink sheet 2 (including sublimation), and transferring fused ink to the recording sheet 1.

And the recording sheet 1 having a certain image formed thereon is further conveyed in the direction of arrow a, cut by a cutter 4, and conveyed by a pair of exhausting rollers 5*a*, 5*b* to exhaust it out of the apparatus.

The recording sheet 1 is contained in a roll holder 7 provided in an apparatus body 6, in which the roll holder 7, the platen roller 3*b*, the cutter 4, and the pair of exhausting rollers 5*a*, 5*b* are provided in the apparatus body.

Also, in this example, the ink sheet 2 is contained in an ink sheet cartridge D having a constitution as will be described later. This ink sheet cartridge D is detachably loaded into a recording cover 9 rotatably affixed via a rotation axis 8 to the apparatus body 6, which cover is an opening/closing member (cover member) for opening and closing an opening portion of the apparatus body 6. The recording head 3*a* is provided on a predetermined position of the recording cover 9.

On the other hand, the recording system B applies the light onto an original 10 and converts its reflected light into an electrical signal, which is transmitted to another equipment or its own recording system A in accordance with the operation mode.

That is, plural originals 10 are laid on an original setting board 9*a* formed on an upper surface of the recording cover 9, and preconveyed by means of a preliminary conveying roller 11*a* and a pressing bar 11*b*, and then individually separated by a separation roller 12*a* and a contacting plate 12*b* for making contact thereon, in which one separated original 10 is further conveyed by a pair of conveying rollers 13*a*, 13*b* and a pair of exhausting rollers 14*a*, 14*b* to be exhausted to an exhaust tray 15. And while the orginal 10 is being conveyed, the original plane is illuminated from a light source 16, and its reflected light is guided via mirrors 17 and a lens 18 to a photoelectric transducer 19 such as CCD, an image signal of which is transmitted to its own recording system in the copy mode, or to the recording system of other equipments in the transmission mode.

The operation panel C is a panel for performing the operations such as mode switching operation, copy operation, and transmission operation, as shown in FIG. 2, with keys corresponding to various operations. The operation panel C is provided on an upper portion of an original conveying mechanism in the reading system B, and rotatably attached to the apparatus body 6. It is to be noted that a telephone handset 20 for transmission and reception is mounted on one end portion of the operation panel C.

In FIG. 1, 21 is a wiring substrate, and 22 is a power supply.

The constitution of each portion such as the recording system A and ink cartridge D as above shown will be described specifically in the following.

Recording Sheet

The recording sheet 1 is a plain paper or plastic sheet, or any of other materials onto which ink is transferrable. In this example, long plain papers of B4 or A4 size are used as the recording sheet 1. And a sheet roll 1*a* having the recording sheet 1 wound as roll is received in a roll holder 7 provided at a predetermined position (substantially central portion in FIG. 1) of the apparatus body 6.

It should be noted that as the recording sheet 1 is wound as roll, some curls may occur. Thereby, to remove such curls, there is provided a decurl shaft 23 near the platen roller 3b in the roll holder 7. The decurl shaft 23 rotates in accordance with the tensile force acting on the recording sheet 1 and in cooperation with a guide shaft 24 as will be described later, so as to remove curls on the recording sheet 1.

In this example, in order to reduce the running cost, the so-called multi-print method is adopted in which in recording, the conveyance speed of ink sheet 2 is made slower than that of recording sheet 1. With this multi-print method, the recording is performed in such a manner that the conveyance length L of recording sheet 1 in recording is made shorter than the conveyance length 1 of ink sheet 2, i.e., L/1=n>1. With such a constitution, the utilization efficiency of ink sheet 2 can be made n times that of a conventional recording method using one-time ink sheet, i.e., L/1=1.

Ink Sheet

The ink sheet 2 is one which allows n times of ink transfers to be performed at the same portion to permit the multi-print as previously described. For this, in this example, it is composed of four layers, i.e., a first layer of heat resisting coat layer 2a, a second layer of base film layer 2b, a third layer of ink layer 2c, and a fourth layer of top coating layer 2d, as shown in FIG. 3.

The heat resisting coat layer 2a serves to protect a base film 2b from the heat of recording head 3a which is a thermal head. Though this heat resisting coat layer 2a is preferable to the multi-print in which the heat energy of n lines may be applied to the same portion (when heat information is consecutively given), it can be appropriately selected in accordance with the recording method whether or not this heat resisting coat layer 2a should be provided. It is effective that the heat resisting coat layer 2a is provided on a base film with relatively low heat resistance such as a polyester film.

The second layer of base film layer 2b serves as a carrier for ink sheet 2, wherein in the multi-print, as the heat energy is applied multiple times at the same location, an aromatic polyamide film or condenser paper is useful, but a conventional polyester film can be also used. Its thickness is preferably about 3 μm to 8 μm, in which it is more favorable from the viewpoint of print quality to be thinner as the role of medium, but the strength must be considered.

The third layer of ink layer 2c is a layer containing the amount of ink allowing for n times of transfers in the recording sheet 1. The ink ingredients are blended so as to withstand n times of services at the same portion, with main components being a resin as the adhesive such as EVA, carbon black or nigrosine dye for the coloring, carnauba wax or paraffin wax as the binding material. The sensitivity or density is varied with the amount of applying this ink layer 2, which can be arbitrarily selected but preferably 4 g/m$^2$ to 9 g/m$^2$.

Also, the fourth layer of top coating layer 2d is a non-recording portion to prevent the third layer of ink layer 2c from being transferred under pressure onto the recording sheet 1, and generally composed of a transparent wax. Thereby, it is only the transparent top coating layer 2d that is transferred under pressure onto the recording sheet 1 among non-recording portions, so that the recording sheet 1 is kept from being dirty on its surface.

It should be noted that the ink sheet 2 is not limited to that construction of this example, but others can be also used, for example, one in which a base layer and a porous ink holding layer for containing ink are provided on one side of the base film, or a heat resisting ink layer having a fine porous mesh structure and containing ink is provided on the base film.

The material of the base film layer 2b may be paper or a film composed of polyimide, polyethylene, polyester, polyvinyl chloride, triacetylcellulose, or nylon, for example. Moreover, the heat resisting coat layer 2a is not necessarily required, in which its material may be silicone resin, epoxy resin, fluorocarbon resin, or nitrocellulose, for example.

An example of the ink sheet 2 having the heat-sublimable ink is one in which a color material layer containing spacer grains formed of guanamine resin and fluorocarbon resin, as well as dye, is provided on a substrate formed of polyethylene terephthalate, polyethylene naphthalate, or aromatic polyamide film.

In this example, to facilitate the operation, the ink sheet 2 is contained in the ink sheet cartridge D.

Ink Sheet Cartridge

A constitution of ink sheet cartridge D is such that a supply reel 25 and a take-up reel 26 are mounted at predetermined positions in a frame body 27, and the ink sheet 2 wound around the supply reel 25 is loaded by looping it around the take-up reel 26, as shown in FIGS. 4 and 6. By using this ink sheet cartridge D, the ink sheet 2 can be loaded in the recording system A quite simply and surely in stable state.

The ink sheet cartridge D is disposed of together with the ink sheet 2, if it has been used. That is, the ink sheet cartridge D must be supplied cheaply owing to its disposability. Next, the constitution of each portion for the ink sheet cartridge D will be described more specifically.

Frame Body

The frame body 27 in this example is formed of a first body 27a and a second body 27b which are ultrasonic welded. That is, it is constituted, as shown in FIG. 4, in such a way that weld zones $27c_1$, $27c_2$ which are connection portions between the first body 27a and the second body 27b are ultrasonic welded, and weld zones $27a_1$, $27a_4$ formed respectively on a substantially top end and a side end of the first body 27a and weld zones $27b_1$, $27b_6$ formed respectively on a substantially top end and a side end of the second body 27b are ultrasonic welded.

The weld zones $27a_1$, $27b_1$ and $27c_1$, $27c_2$ may be formed over the entire length, or formed intermittently with predetermined lengths in a width direction of ink sheet.

As a molding material of the frame body 27, a resin such as polypropylene or ABS resin can be used.

In the frame body 27, a window 27d for inserting recording head 3a is formed in a substantially central portion of the first body 27a, as shown in FIG. 4, and a window 27e for inserting platen roller 3b is formed in a substantially central portion of the second body 27b , with a notch $27e_1$ into which a shank $3b_1$ (see FIG. 1) of the platen roller 3b can run off being formed continuously with that window 27e.

On both sides of the first body 27a and the second body 27b are vertically formed side plates $27a_2$, $27b_2$, respectively, and on the weld zones $27c_1$, $27c_2$ and the open sides are formed curved surfaces of quarter circle, respectively. On the weld zone $27a_1$ formed in a curved end portion on the open side of the first body 27a, a fit-in hole $27a_3$ is punched, and on the weld zone $27b_1$ formed in a curved end portion on the open side of the second body 27b, a fit-in projection $27b_3$ for fitting into the fit-in hole $27a_3$ is formed. Further, in curved surface on the open side of the second body 27b is formed an interlock projection $27b_4$ for interlocking with a lock latch as will be described later provided on tile cover 9, in loading the ink sheet cartridge D into the recording cover 9.

At predetermined positions on both sides of the side plate $27b_2$ of the second body 27b are formed guide pins 27f serving as the guides in loading the ink sheet cartridge D into the recording cover 9.

Also, at predetermined positions of the side plates $27a_2$, $27b_2$ are formed U grooves $27g_1$ into which bearings 28a attached to both ends of the supply reel 25 are loosely fitted, and U grooves $27g_2$ into which bearings 28b attached to both ends of the take-up reel 26 are loosely fitted, respectively. Further, the first body 27a and the second body 27b are formed with openigns $27h_1$, $27h_2$ for exposing a reel gear 25c of the supply reel 25 and a reel gear 26c of the take-up reel 26, respectively.

Supply Reel and Take-up Reel

The supply reel 25 as the first winding member and the take-up reel as the second winding member serve to wind the ink sheet 2, cooperatively, in which the reel shafts 25a, 26a having substantially same length as that of the ink sheet 2 are provided with flanges $25b_1$, $25b_2$, $26b_1$, $26b_2$ on both end portions thereof, and the reel gears 25c, 26c are integrally formed on one of the flanges $25b_1$, $26b_1$.

And in recording, by transmitting the driving force to the take-up reel gear 26c to rotate the take-up reel shaft 26a and to wind the ink sheet 2 around the reel shaft 26a, the sheet 2 is conveyed in a direction opposite to the conveying direction (direction of arrow b as shown in FIG. 1) of recording sheet 1.

If the ink sheet 2 is conveyed and wound in the direction opposite to the conveying direction of recording sheet 1, as above described, the ink sheet 2 is greatly tensioned (5 kgf in this embodiment) during its conveyance. Accordingly, if the strength of the take-up reel shaft 26a is insufficient, the shaft 26a is bent, thereby producing wrinkles in the ink sheet 2 or conveying irregularities, resulting in decreased quality of image.

Further, there is provided a recording apparatus in which the ink sheet cartridge D and the take-up driving mechanism 41 are provided on the recording cover 9, which is opened by turning it upward and held at any location on the way of such rotation. In this case, it is common to dispose the take-up reel shaft 26b having the heavy driving mechanism 41 closer to the rotation shaft 8, and dispose the supply reel shaft 26a farther away from the rotation shaft 8.

However, as the supply reel shaft 26a is also subjected to a tension (1.8 to 3.8 kgf in this example) from the ink sheet 2, it is also required to have a predetermined strength. Here, if the strength of the supply reel shaft 26a is increased, the weight of the supply reel shaft 26a is also increased. As a result, the rotational moment relative to the rotation shaft 8 of the supply reel shaft 26a becomes larger, so that a larger structural load is applied on the rotation shaft 8 or cover stay 34 for holding the recording cover 9 at any position on the way of rotation. Further, the load on latch means 38 for fixing the ink sheet cartridge D to the recording cover 9 is also increased.

Thus, in this example, the supply reel shaft 25a is made of paper (e.g. kraft paper), while the take-up reel shaft 26a is formed of an aluminum tube having the high strength of material. The supply reel shaft 25a is lighter than the take-up reel shaft 26a. Note that the take-up reel shaft 26a may be formed of a material having high mechanical strength, such as iron or brass, or can be formed to have sufficient strength by making larger the outer diameter of the take-up reel shaft 26a than that of the supply reel shaft 25a, even with a material having low strength.

In this example, the outer diameter $D_1$ of the supply reel shaft 25a is set to be about 22 mm, the outer diameter $D_2$ of the take-up reel shaft 26a is also set to be about 22 mm, the wall thickness $t_1$ of the supply reel 25a is set to be about 5 mm, and the wall thickness $t_2$ of the take-up reel 26a is set to be about 2 mm. And the take-up reel shaft 26a made of aluminum alloy has a Brinell hardness $H_B$ of 26 to 150. With the above constitution, the flexural rigidity of the supply reel shaft 25a is EI $1.2\times10^6$ kgmm$^2$, while that of the take-up reel shaft 26a is EI $4.6\times10^7$ kgmm$^2$, with the take-up reel shaft 26a being stronger in rigidity than the supply reel shaft 25a.

It is preferable that the flexural rigidity of the supply reel shaft 25a is set in a range from about EI $0.5\times10^6$ kgmm$^2$ to $2.5\times10^6$ kgmm$^2$, and that of the take-up reel shaft 26a is set in a range from about EI $3\times10^7$ kgmm$^2$ to $5.5\times10^7$ kgmm$^2$. Next, the weight of the supply reel shaft 26a will be described. When the same aluminum tube as the take-up reel shaft 26b is used for the supply reel shaft 26a, the weight of the tube is 94.4 g and the distance from the rotation shaft 8 to the supply reel shaft 26a is 17.3 cm, so that the rotational moment of the aluminum tube becomes 1.6 kg.cm. On the contrary, when a paper tube is used as in this example, the weight of the tube is 58.7 g, so that the rotational moment of the paper tube can be reduced to 1.0 kg.cm. Therefore, the load applied on the rotation shaft 8 and cover stay 34 or the latch means 38 of recording cover 9 in the the recording apparatus could be remarkably decreased.

In this way, by providing the take-up reel shaft 26a with higher rigidity, even if a great force may be applied thereto in winding the ink sheet, there will occur no slacks or wrinkles of the ink sheet 2 in winding, resulting in no failures of image in recording.

Identification Pieces

As shown in FIGS. 4 and 5, at predetermined positions of the first body 27a, identification means 27i is provided to identify the size of ink sheet 2 loaded into the ink sheet cartridge D, and the recording n value of ink sheet 2 in respect to the recording sheet 1.

In this example, three identification pieces $27i_1$, $27i_2$, $27i_3$ are provided on the identification means 27i. The identification pieces $27i_1$, $27i_2$, $27i_3$ are formed by cutting away a part of the first body 27a made of a synthetic resin, and made thinner at their bottom portions so as to remove away each piece as required. The identification pieces $27i_1$, $27i_2$, $27i_3$ serve to press an actuator of a microswitch 29 attached to the recording cover 9, when the ink sheet cartridge D is loaded into the recording system A, so that the size of ink sheet 2 can be identified upon predetermined identification pieces turning on the microswitch 29.

As previously described, by forming the bottom portion of identification piece as thinner wall, each of identification pieces $27i_1$, $27i_2$, $27i_3$ has elasticity. In general, the movement amount of the actuator for the microswitch 29 is several millimeters, in which for proper operation, the identification pieces $27i_1$, $27i_2$, $27i_3$ must stroke over the actuator. In this respect, since the identification pieces $27i_1$, $27i_2$, $27i_3$ in this example have the elasticity as above described, they are elastically deformed to depress the actuator of the microswitch 29 securely, when the ink sheet cartridge D is loaded into the recording cover 9.

In this example, the identification pieces $27i_1$, $27i_2$, $27i_3$ allow the detection for the presence or absence of ink sheet cartridge D, the size of ink sheet 2, and the recording n value, and the control for detection will be described later.

Ink Sheet Slack Preventing Member

Figure 8:
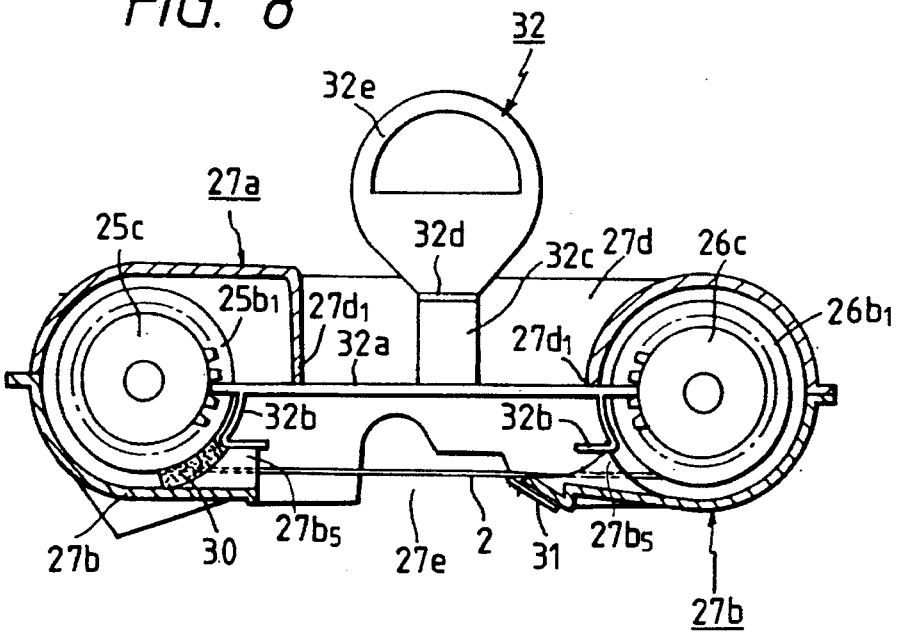
FIGS. 8 and 9 are constitutional explanation views in which a stopper is attached to the ink sheet cartridge.

Preventing slacks of the ink sheet 2 will be described in the following. As shown in FIGS. 4 and 8, on a portion of the second body 27b where the supply reel 25 is attached and the flange $25b_1$ is located, a sponge 30 is pasted. This sponge 30 is placed in contact with the flange $25b_1$ when the supply reel 25 is attached, and serves to give a rotational load to the supply reel 25 and to prevent the ink sheet 2 from slackening due to inadvertent rotation of the supply reel 25 when the recording cover 9 is opened or closed.

The larger the contact pressure between the flange $25b_1$ and the sponge 30 is, the greater the rotational load is, wherein this rotational load is set to be large enough not to damage the ink sheet 2 when the ink sheet 2 is drawn out from the supply reel 25 owing to driven rotation of the take-up reel 26 in recording.

It should be noted that in this example, as the sponge 30 is deformed by about 1 to 1.5 mm due to the pressed contact with the flange $25b_1$, in recording, it is subjected to a rotational load of about 50 to 200 g due to its frictional force when the supply reel 25 is rotated.

Guide Member for Recording Sheet

On an edge portion of the window 27*e* for platen roller formed on the second body 27*b* and upstream in a conveying direction of recording sheet, a guide member 31 is mounted as shown in FIGS. 1 and 6. This guide member 31 guides the recording sheet 1 in recording, as will be described later, while preventing the recording sheet 1 from being rolled into the ink sheet cartridge D, and in this example, a Mylar sheet is pasted along the edge of the window 27*e*.

Assembly of Ink Sheet Cartridge

Assembling and packing of the ink sheet cartridge D will be described in the following.

As shown in FIG. 4, on both ends of the supply reel shaft 25*a* having the ink sheet 2 wound and the take-up reel shaft 26*a*, the reel gears 25*c*, 26*c* and the flanges $25b_2$, $26b_2$ are formed protruding outward therefrom. Accordingly, on both ends of the reel shafts 25*a*, 26*a* are attached the bearings 28*a*, 28*b*, respectively, which are loosely fitted into the U grooves $27g_1$, $27g_2$ formed on the second body 27*b*. And the ink sheet cartridge D having the ink sheet 2 loaded therein is assembled as shown in FIGS. 5 and 6, by ultrasonic welding the weld zones $27a_1$ and $27b_1$, as well as the weld zones $27a_4$ and $27b_6$, respectively, with the first body 27*a* being placed opposed to the second body 27*b*.

Reel Gear Idle Running Preventing Stopper

Figure 9:
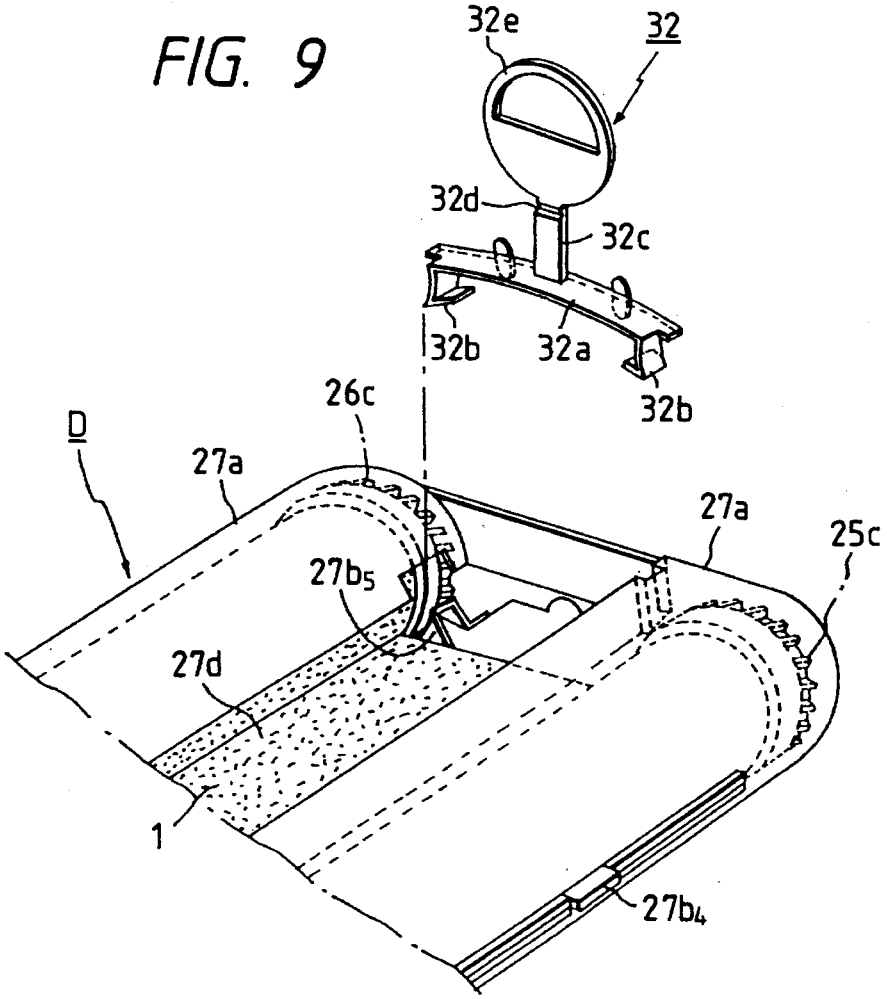

If the supply reel 25 and the take-up reel 26 make idle run due to the vibration in transporting and storing the ink sheet cartridge D, the ink sheet 2 may be slackened. In this example, in order to prevent slacks of the ink sheet 2, there is provided a stopper 32 acting as a restriction member for restricting the rotations of the supply reel 25 and the take-up reel 26 as shown in FIGS. 8 and 9.

The stopper 32, made of a synthetic resin, is formed slightly longer than the distance between the supply reel gear 25*c* and the take-up reel gear 26*c*, wherein idle running of both gears 25*c*, 26*c* can be prevented by fitting both ends of an elastically deformable interlock portion 32*a* between the supply reel gear 25*c* and the take-up reel gear 26*c*.

In the vicinity of both ends of the interlock portion 32*a*, there are provided hook trailing pieces 32*b* protruded therefrom, wherein if the interlock portion 32*a* is fitted between both gears 25*c*, 26*c*, as shown in FIG. 8, the lower ends of trailing pieces 32*b* are placed in contact with projecting portions $27b_5$ formed on the second body 27*b*, and the upper ends of the interlock portion 32*a* are placed in contact with window edge portions $27d_1$ of the first body 27*a*. Thereby, both ends of the interlock portion 32*a* are elastically fitted and fixed in the reel gears 25*c*, 26*c*.

On a central portion of the interlock portion 32 in a longitudinal direction is protruded a standing member 32*c* on an upper portion of which a drawn ring portion 32*e* is provided via a thinner wall portion 32*d*. Accordingly, as shown in FIG. 8, when removing the stopper 32 fitted and interlocked between the supply reel gear 25*c* and the take-up reel gear 26*c*, the stopper 32 can be easily removed by holding the drawn ring portion 32*e* and drawing it upward in FIG. 8.

It should be noted that the standing portion 32*c* is placed under a depth of the first body 27*a*, in the state with the stopper 32 fitted thereto, and the stopper 32 does not protrude above the first body 27*a* in a state where the drawn ring portion 32*e* is folded at the thinner wall portion 32*d*.

Packing Member

Figure 10:
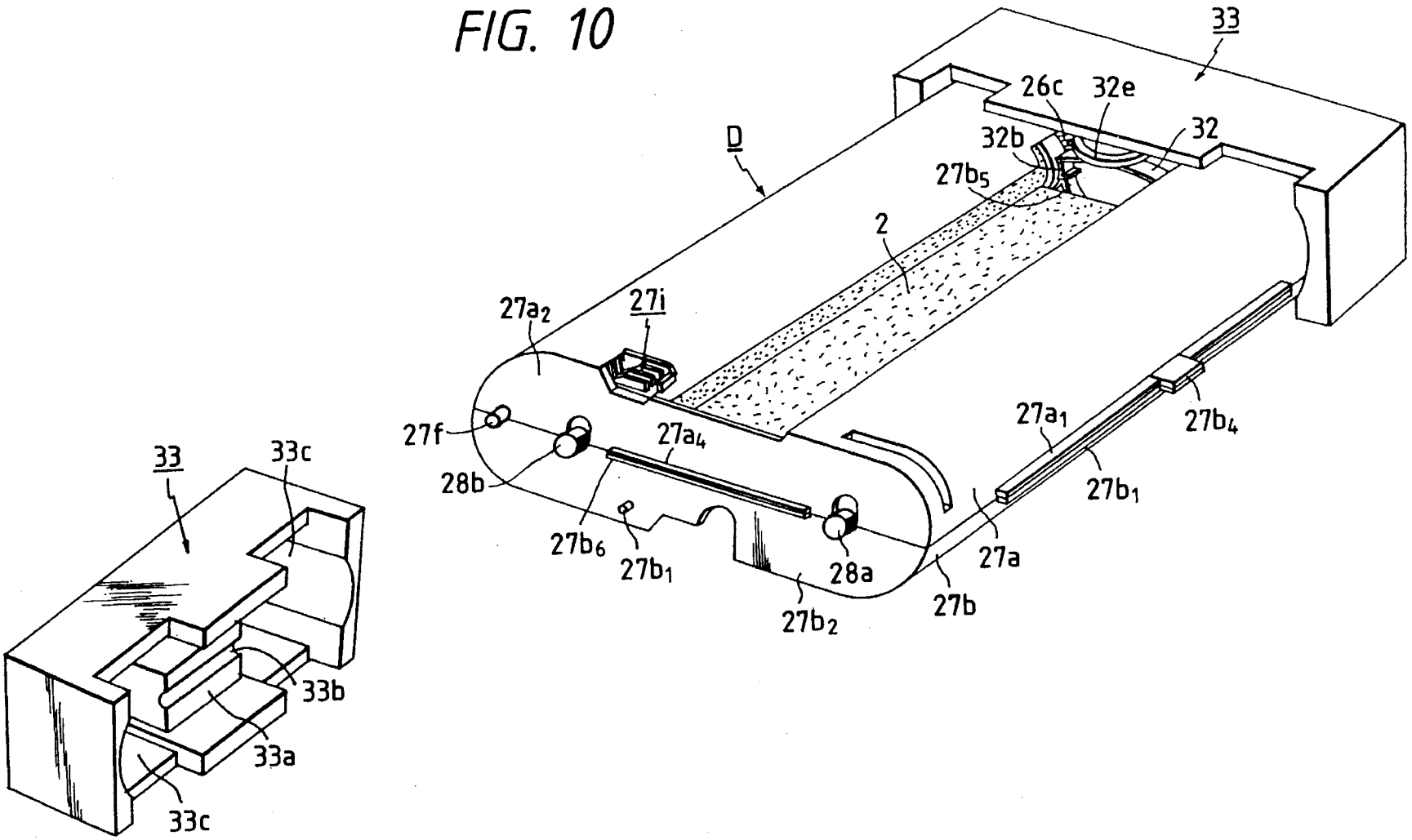
FIGS. 10 to 12 are explanation views in packing up the ink sheet cartridge.

When the ink sheet cartridge D is transported, it is packed using a packing member 33 as shown in FIG. 10 to mitigate the impact from dropping or vibration of the cartridge D.

Figure 11:
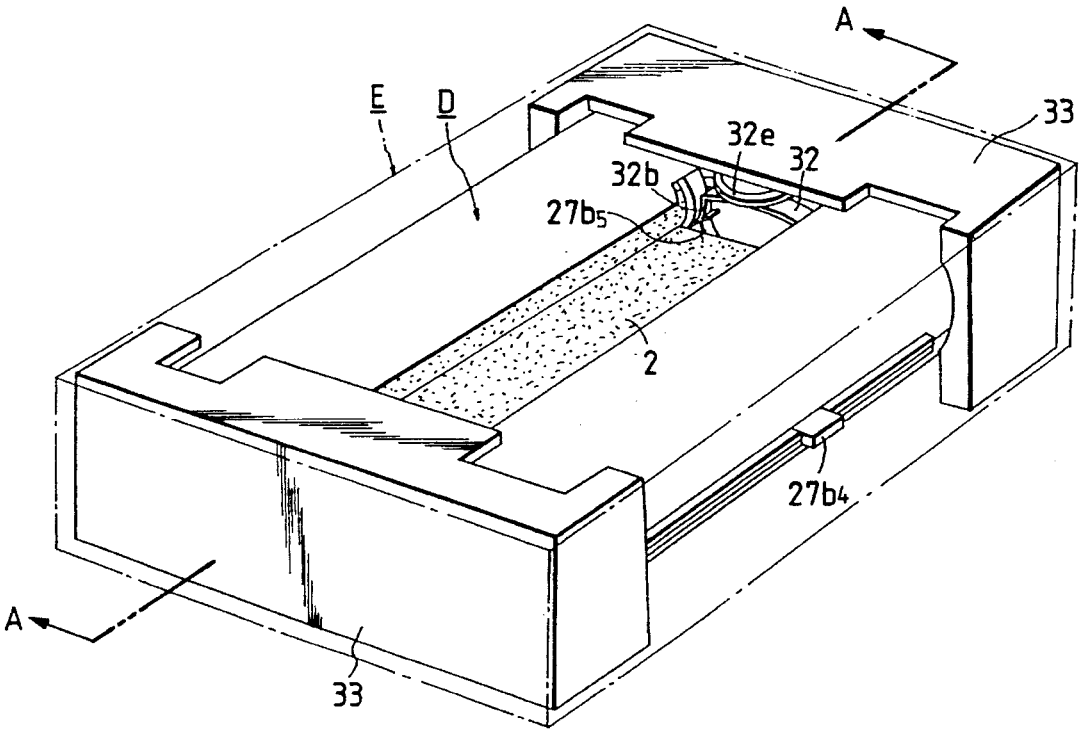
Figure 12:
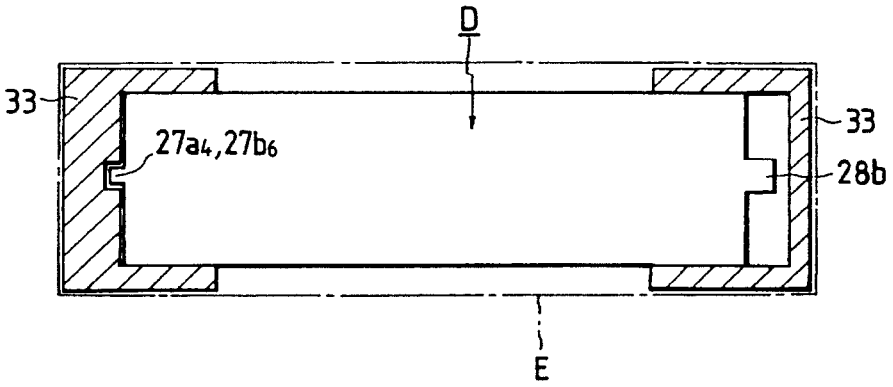

The packing member 33 in this example is made of polystyrene foam and formed with a recess so as to be attached onto side end portions of the ink sheet cartridge D. Specifically, as shown in FIGS. 10 to 12, the packing member 33 is formed with an abutment portion 33*a* on which side plates $27a_2$, $27b_2$ of the frame body 27 can abut, when attached into the side portions of the ink sheet cartridge D, and further a recess 33*b* for receiving the weld zones $27a_4$, $27b_6$ in a central portion of the abutment portion 33*a*. Further, on both sides of the abutment portion 33*a* is formed a recess 33*c* for receiving the bearings 28*a*, 28*b* and a guide pin 27*f*.

Accordingly, in the state in which the packing member 33 is attached and contained in a case E as shown in FIG. 11, the weld zones $27a_4$, $27b_6$, the bearings 28*a*, 28*b* and the guide pin 27*f* which are easily damaged by the impact are placed in floating state relative to the packing member 33, as shown in FIG. 12 (cross-sectional view taken along A—A of FIG. 11). Thus, even if the ink sheet cartridge D is subjected to impact due to dropping during transportation, the impact applied to the packing member 33 is not transmitted directly from the packing member 33 to the bearings 28*a*, 28*b*. Therefore, it is possible to effectively protect the bearings 28*a*, 28*b* from being damaged.

It should be noted that when the packing member 33 is attached to the side portions of the ink sheet cartridge D, the drawn ring portion 32*e* of the stopper 32 does not interfere with the packing, because it is folded at the thinner wall portion 32*d*, as shown in FIG. 11.

Next, a constitution for loading the ink sheet cartridge D into the recording system A will be described.

Recording Cover

As shown in FIGS. 1 and 2, the apparatus body 6 has the recording cover 9 mounted so as to open and close, which is a loading portion for the ink sheet cartridge D.

In a conventional facsimile terminal equipment, a rotational center of the recording cover 9 in the apparatus body 6 is provided downward of the operation panel C. Therefore, in opening the recording cover 9, an end portion of the original setting board provided on an upper plane of the cover 9 is separated away from the operation panel C, so that the length of whole apparatus becomes longer.

On the contrary, in this example, the rotational center of the recording cover 9 in the apparatus body 6 is positioned across from the operation panel C and at end portion of the original setting board 9*a* formed on the upper plane of recording cover 9. And the upper plane of recording cover 9 is constituted as the original setting board 9*a*, wherein the original setting board 9*a* is formed with a horizontal section $9a_1$ for laying originals 10 and an inclined section $9a_2$ continuously and downwardly inclining toward the reading system B, with the horizontal section $9a_1$ being arranged at a substantially same height as an upper plane of the operation panel C.

Note that the inclined section $9a_2$ is provided with a slider 9*c* for guiding originals 10, the slider 9*c* being slidable in accordance with the size of original 10.

Figure 13:
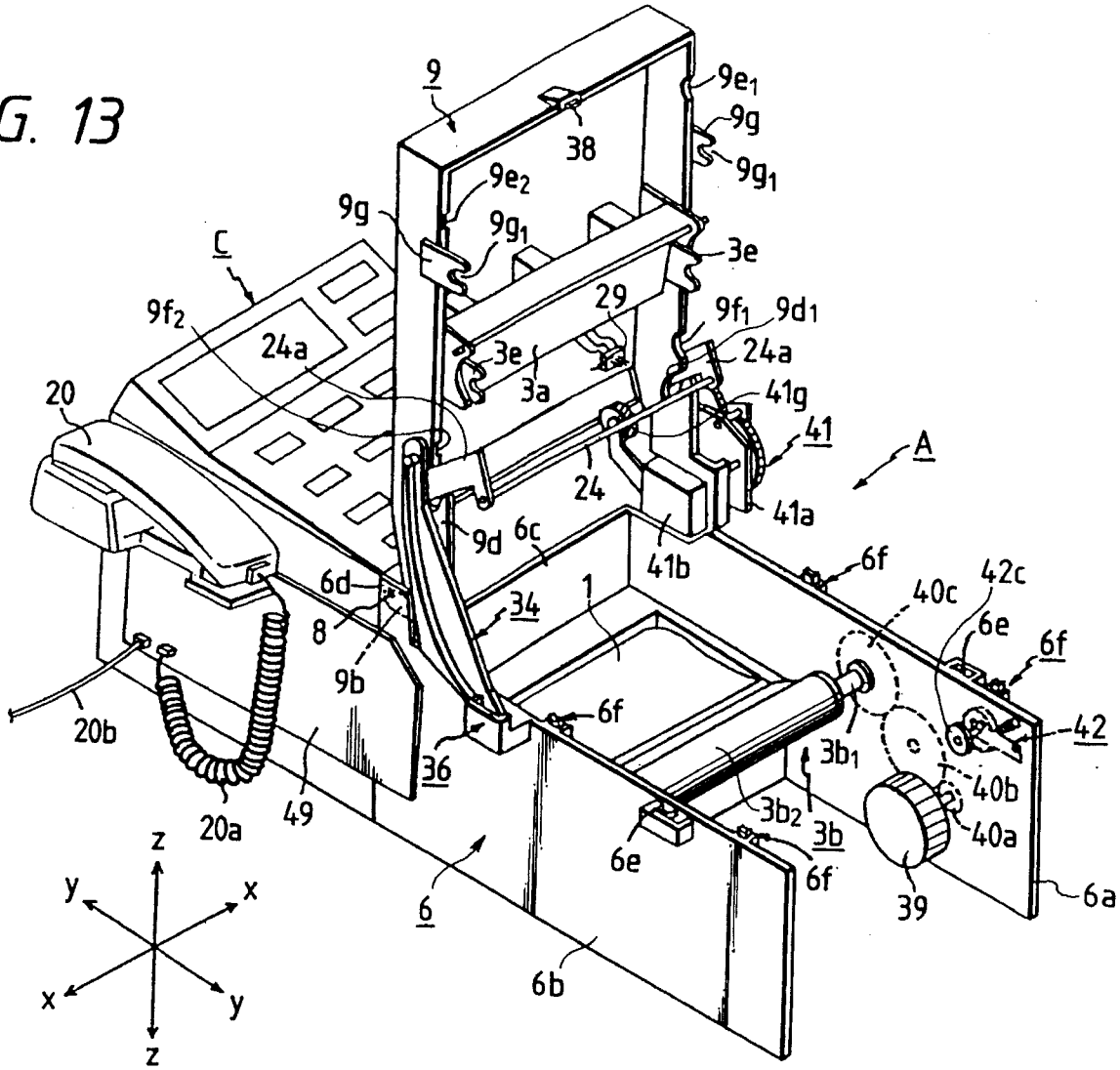
FIGS. 13 and 14 are explanation views of an apparatus body and a recording cover.
Figure 14:
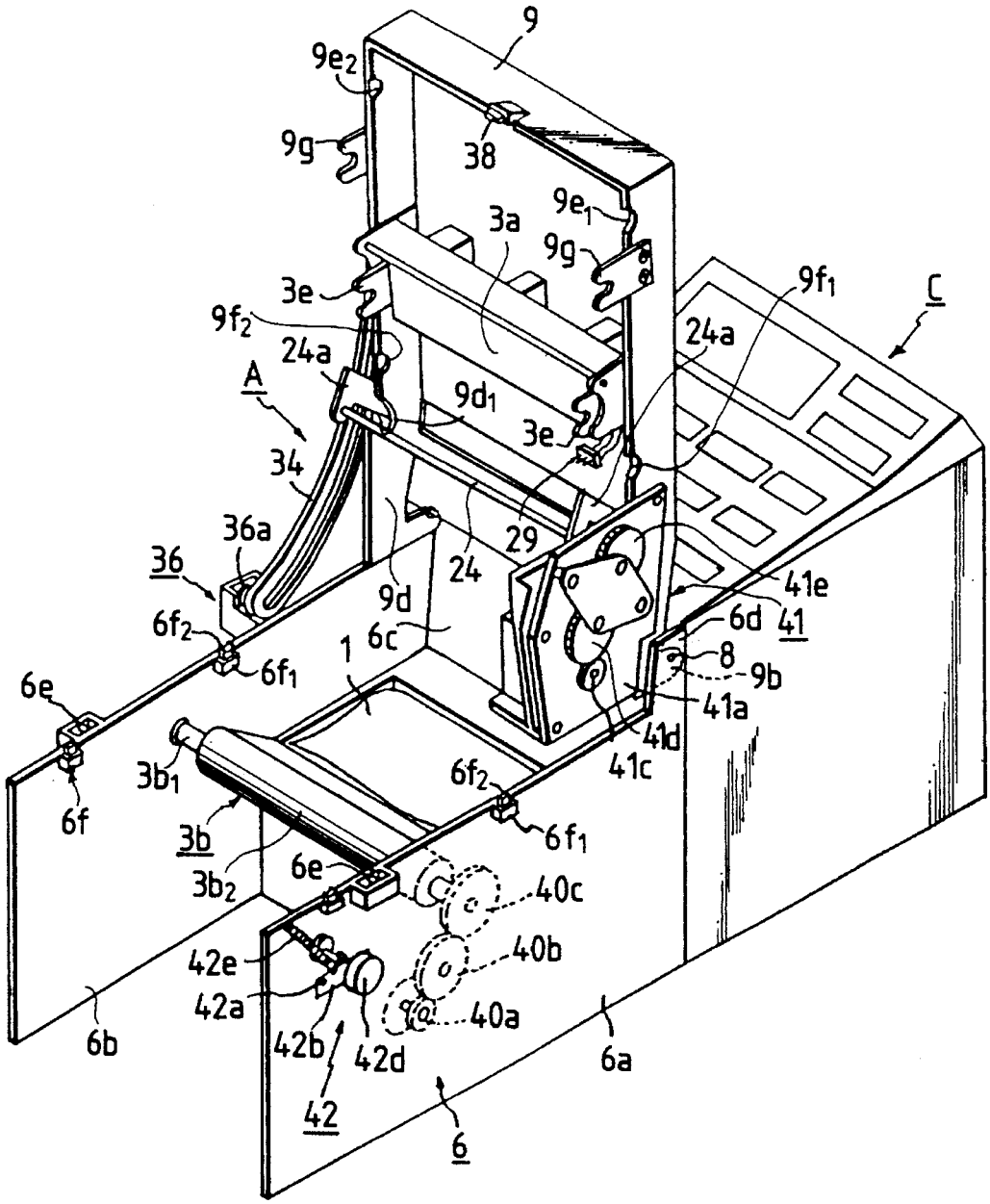

At an end portion of the recording cover 9 on the side of recording system B, i.e., at an end portion of the inclined section $9a_2$ in the original setting board 9*a*, shaft members 9*b* having a rotational shaft 8 are provided on both sides, as shown in FIGS. 13 and 14. The shaft members 9*b* protrude toward the original setting board 9*a* of the recording cover 9, and are constituted to position the rotational shaft 8 sideway of the operation panel C.

Figure 15A:
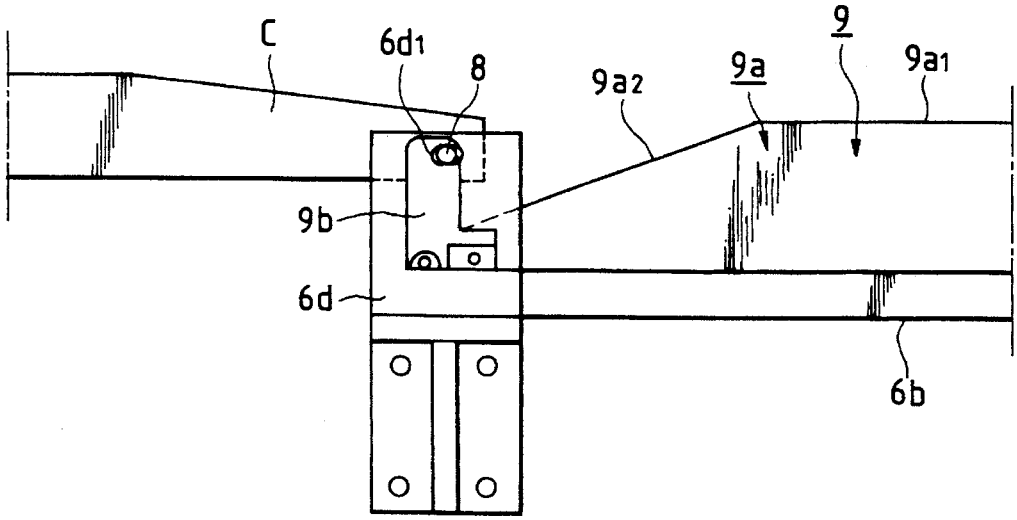
FIGS. 15A and 15B are explanation views for attachment of the recording cover to the apparatus body.
Figure 15B:
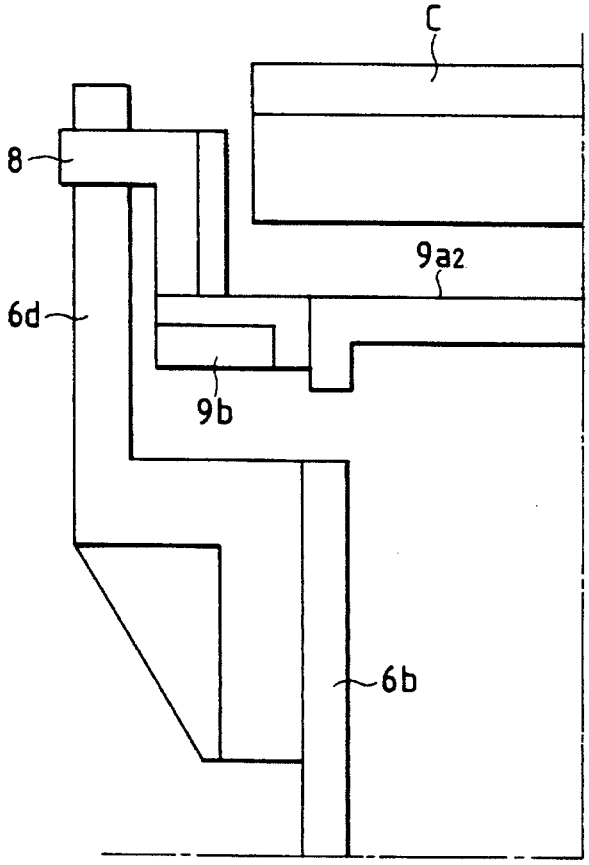

Also, the apparatus body 6 is surrounded by both side walls 6*a*, 6*b*, and has a partition wall 6*c* provided between the recording system A and the reading system B, with a pair of brackets 6*d* formed opposed to each other on end portions of the partition wall 6*c*. The brackets 6*d* are support portions for rotatably mounting the recording cover 9 to the apparatus body 6. Thus, the brackets 6*d* are formed with shaft holes $6d_1$ into which the rotational shaft 8 provided on the recording cover 9 is fitted, as shown in FIGS. 15A and 15B. The shaft holes $6d_1$ may be formed as round holes, whereas in this example, they are formed as long holes so that the recording cover 9 can be moved in the forward and backward directions with respect to the apparatus body 6. By fitting the rotational shaft 8 of the recording cover 9 into the shaft holes $6d_1$, the recording cover 9 can be mounted to the apparatus body 6 so as to be able to open and close.

As above described, by positioning the rotational center of the recording cover 9 in the apparatus body 6 sideway of the operation panel C and at the end portion of the original setting board 9*a*, the interference between the end portion of operation panel C and that of original setting board 9*a* can be eliminated in opening the recording cover 9. Accordingly, it is possible to arrange the operation panel C closer to the original setting board 9*a*, and thereby to shorten the length of apparatus body.

Cover Stay

In closing the recording cover 9, the rotational shaft 8 is subject to a weight of the recording cover 9 acting on its gravitational center, and a rotational torque in accordance with the horizontal distance between the rotational shaft 8 and the gravitational center. Accordingly, when the recording cover 9 is dropped freely in the open state, it is subject to the impact due to the action of the rotational torque tending to close the recording cover 9. Therefore, a conventional recording apparatus has a torsion coil spring attached to the rotational shaft of the recording cover, so as to produce a damping force with that spring. However, as the rotational shaft is usually provided at the end portion of the recording cover, there is a long distance from the rotational shaft to the gravitational center of the recording cover, so that the spring force of the torsion coil spring must be increased.

Figure 16A:
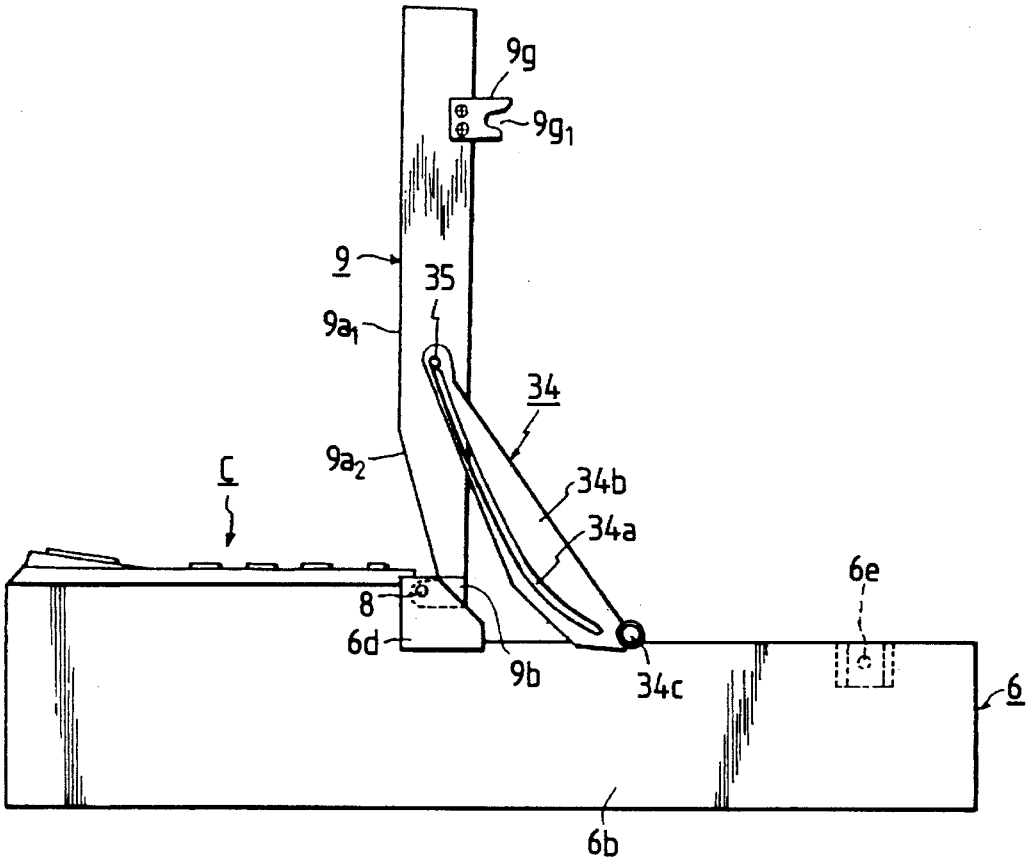
FIGS. 16A and 16B are explanation views for rotation of an opening/closing cover in relation to the apparatus body.
Figure 16B:
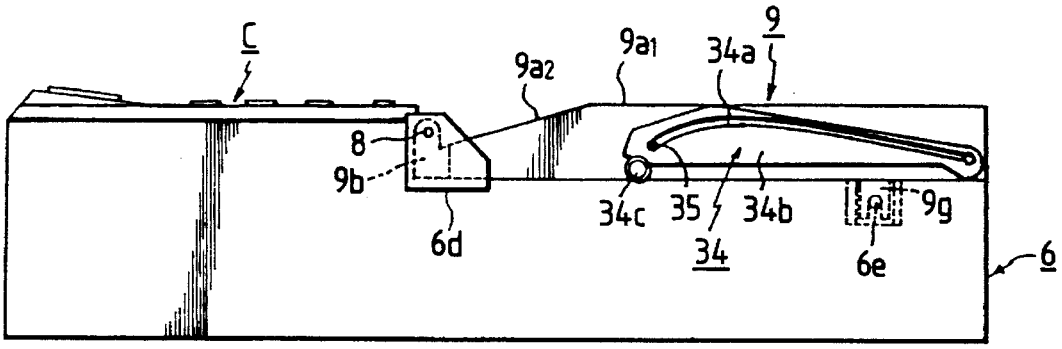

Thus, in this example, a cover stay 34 is attached to maintain the open attitude of the recording cover 9, as shown in FIGS. 16A and 16B, whereby the torsion coil spring is affixed to the rotational shaft of the cover stay 34 to produce the damping force.

Figure 17:
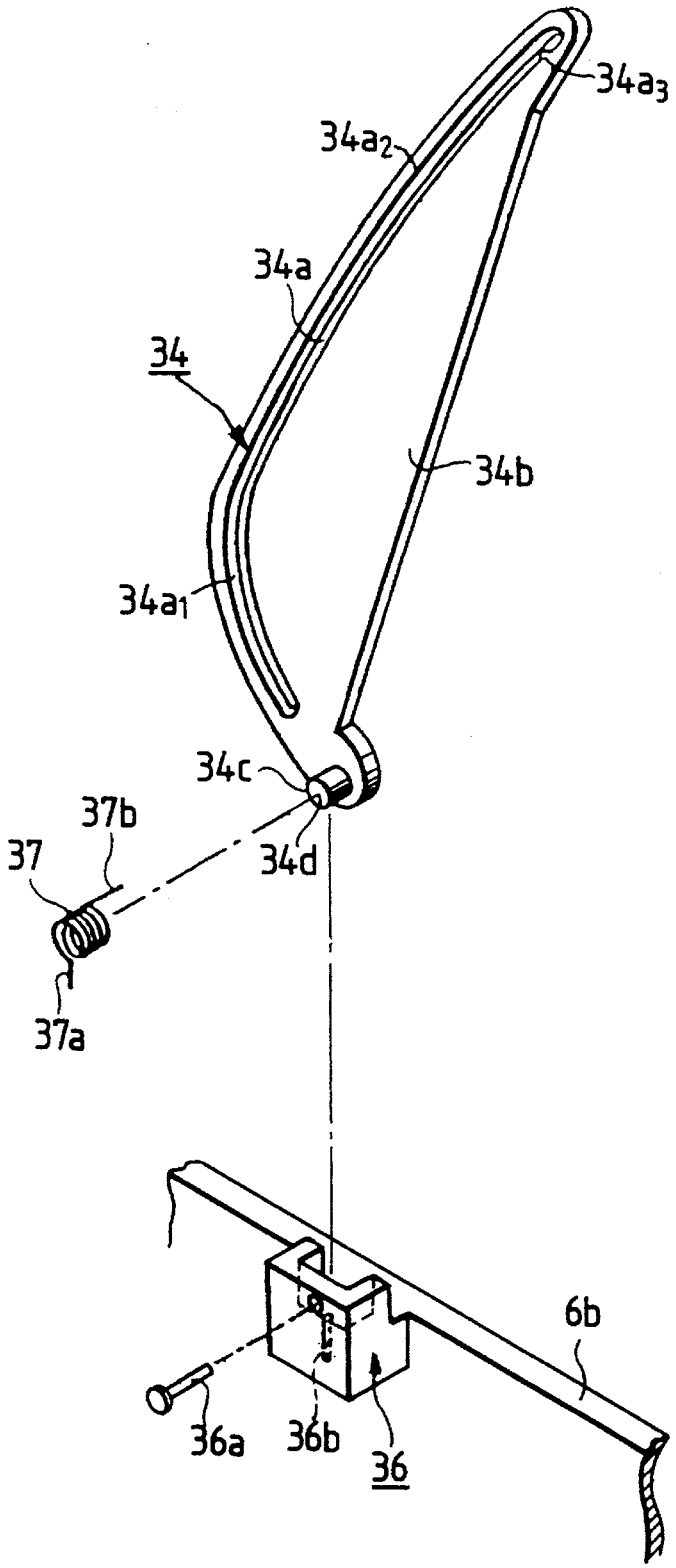
FIG. 17 is an explanation view for attachment of a cover stay.

That is, the cover stay 34 is rotatably attached to one side wall 6*b* of the apparatus body 6, with a pin 35 provided on the recording cover 9, as shown in FIGS. 16A, 16B and 17. And the cover stay 34 is mounted to a mounting portion 36 provided on the side wall 6*b*. The position of the mounting portion 36 is located closer to the gravitational center position G (see FIG. 18) of the recording cover 9 than the rotational shaft 8 acting as a rotational center of the recording cover 9 in respect to the apparatus body 6. Also, the pin 35 is provided near the gravitational center position of the recording cover 9.

The cover stay 34 is constituted of a plate portion 34*b* having a groove 34*a* formed therein, and a shank 34*c* for affixing the torsion coil spring 37. The groove 34*a* has an arc-like groove $34a_1$ in the neighborhood of the shank 34*c*, as shown in FIG. 17, and a linear groove $34a_2$ consecutive with the arc-like groove $34a_1$, which is substantially linear. And the pin 35 provided on the recording cover 9 is fitted into the groove 34*a*, so that the rotational force of the recording cover 9 is transmitted to the cover stay 34. Note that a projection $34a_3$ formed at the end portion of the groove $34a_2$ serves to hold the recording cover 9 in the open state by engaging the pin 35.

The shank 34*c* is formed with a through hole 34*d* passing through in the axial direction. By fitting the cover stay 34 via the through hole 34*d* onto a shaft 36*a* provided on the mounting portion 36, the stay 34 is attached to the apparatus body 6 so as to be rotatable around the shaft 36.

On an external periphery of the shank 34*c* is affixed the torsion coil spring 37. One arm 37*a* of the torsion coil spring 37 is fitted into a groove 36*b* formed on the mounting portion 36, as shown in FIG. 17, while the other arm 37*b* is a free end. And the torsion coil spring 37 is attached to the shank 34*c* so as to act as no interference member when the cover stay 34 is rotated in a direction of closing the recording cover 9, and as no locking member when it is rotated in a direction of opening the recording cover 11. The inner diameter of the torsion coil spring 37 is formed to be substantially equal to, or slightly less than, the outer diameter of the shank 34*c*. Accordingly, a frictional load is always exerted between the torsion coil spring 37 and the shank 34*c*. With the mounting of the cover stay 34 constituted as above, it is possible to generate the damping force with the torsion coil spring 37 upon closing the recording cover 9.

Figure 18A:
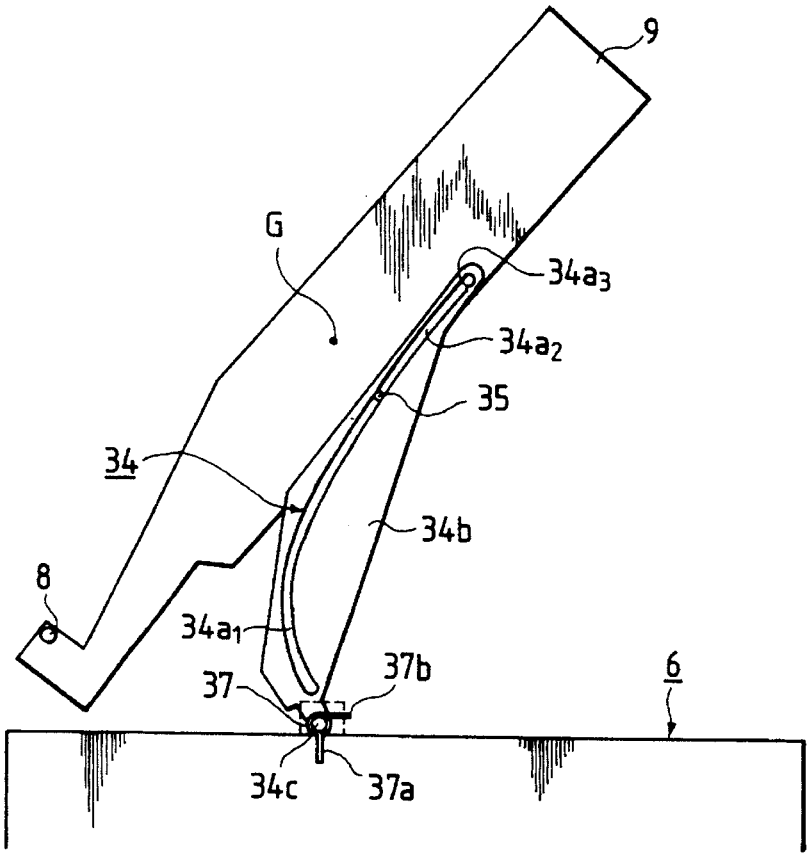
FIGS. 18A and 18B are explanation views for rotation of the cover stay.
Figure 18B:
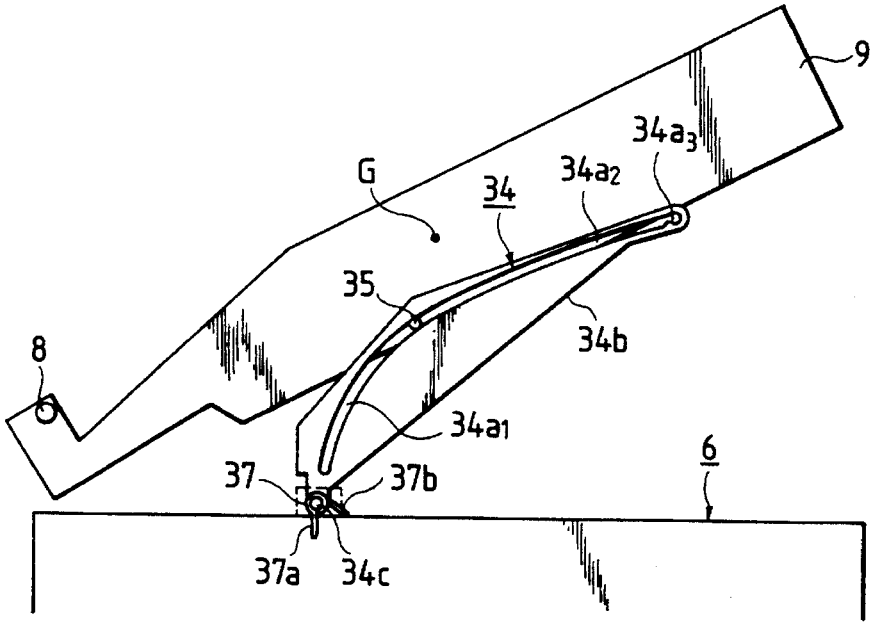

That is, while transferring from the open state of the recording cover 9 as shown in FIG. 16A to the close state of the recording cover 9 as shown in FIG. 16B (while transferring the recording cover 9 from the open state to the close state in the motion at uniform angular velocity), the linear groove $34a_2$ of the cover stay 34 is brought into engagement with the pin 35, as shown in FIG. 18A. Along with the rotation of the recording cover 9, the cover stay 34 is rotated, but the rotation angle is not large because of the linear shape of groove $34a_2$. And if the recording cover is further rotated so that the pin 35 engages the arc-like groove $34a_1$ as shown in FIG. 18B, the rotation angle of the cover stay 34 becomes large. Accordingly, the frictional load between the torsion coil spring and the shank 34*c* becomes large, so that the spring 37 acts as no interference to exert the damping force to the cover stay 34. At this time, the rotational torque acting on the shank 34*c* of the cover stay 34 becomes less than that acting on the rotation shaft 8 of the recording cover 9, so that the rigidity of torsion coil spring 37 can be reduced.

Relation Between Guide Shaft and Ink Sheet Cartridge

The constitution of attachment in loading the ink sheet cartridge D to the recording cover 9 will be described in the following.

As shown in FIGS. 13 and 14, at predetermined positions of the recording cover 9 are formed an interlock portion 9*d* having a hook groove $9d_1$ for interlocking a guide pin 27*f* of the ink sheet cartridge D, and bearing grooves $9e_1$, $9e_2$ and $9f_1$, $9f_2$ as the first contact portion for positioning the bearing 28*a*, 28*b*. Note that the bearing grooves $9e_1$, $9f_1$ are formed as the U grooves passing across the recording cover 9, while the bearing grooves $9e_2$, $9f_2$ are formed as the U grooves with their end portions in axial direction closed.

Figure 19A:
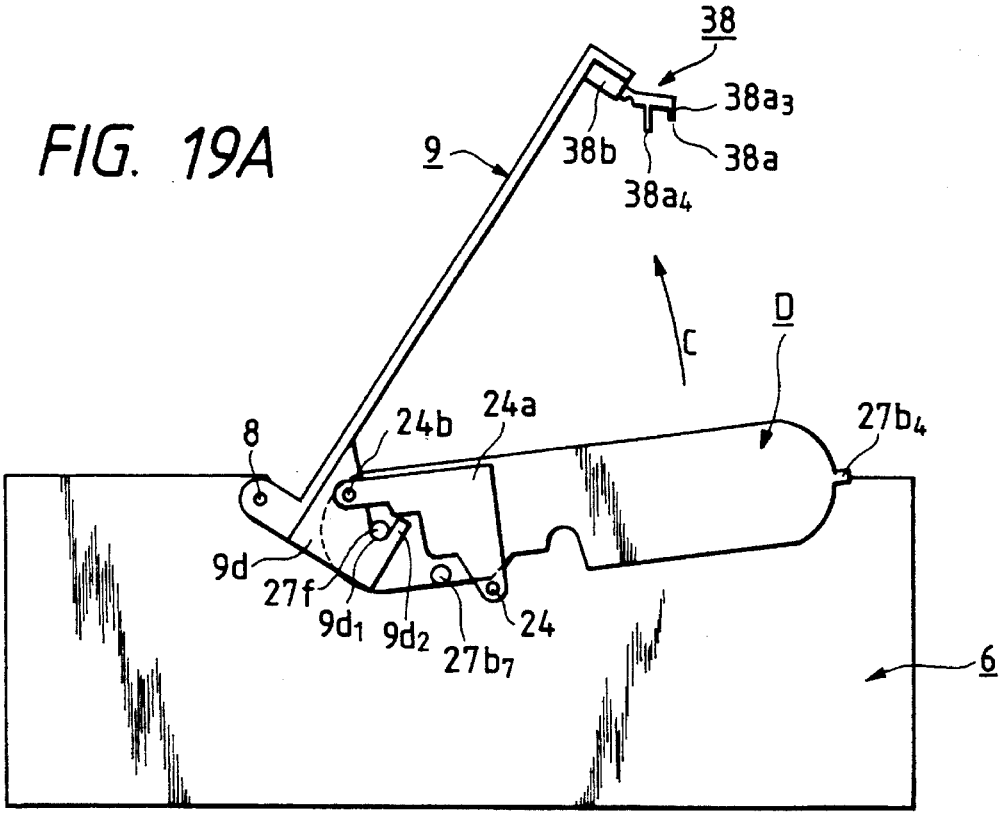
FIGS. 19A and 19B are explanation views for the state where the ink sheet cartridge is loaded into the recording cover.
Figure 19B:
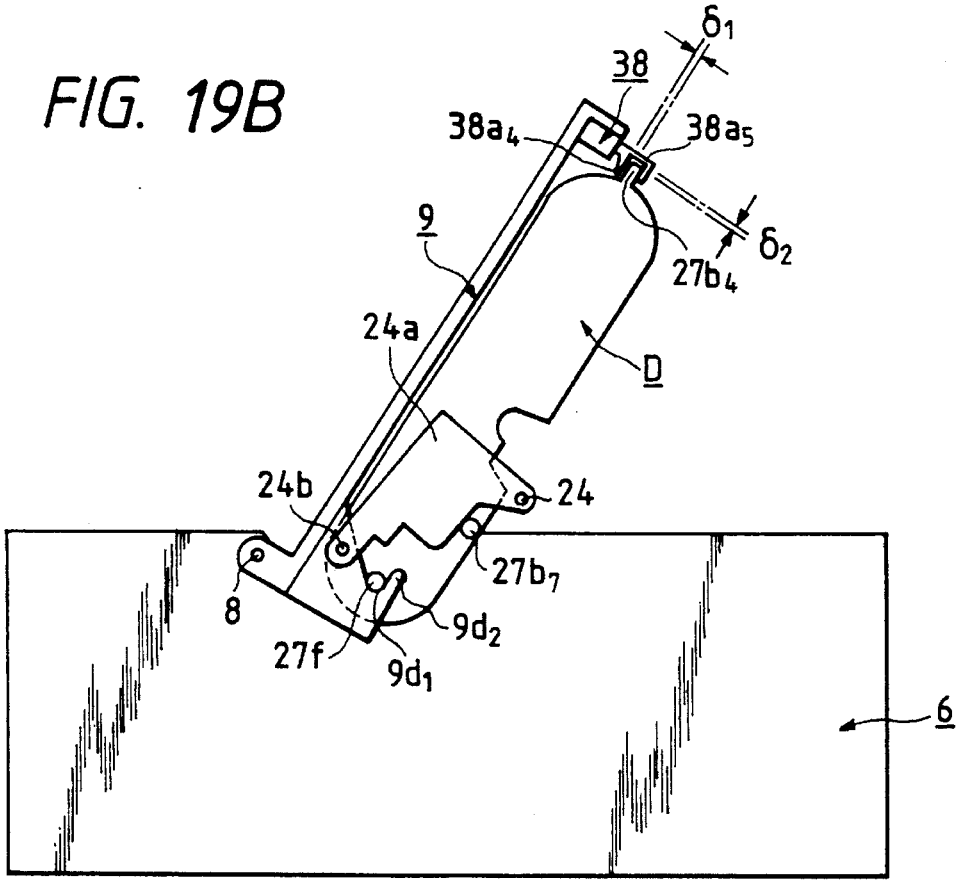

Also, on the recording cover 9 are rotatably attached L-shape arms 24*a* secured on both ends of a guide shaft 24, which is a direction reversing member for reversing the conveying direction of the recording sheet 1 via the shaft 24*b* as shown in FIGS. 19A and 19B. The arms 24*a* are contacted against stopper portions $9d_2$ formed at end portions of the interlock portion 9*d*, when the recording cover 9 is opened as shown in FIG. 19A, so that the rotation can be restricted.

Accordingly, in order to load the ink sheet cartridge D into the recording cover 9, the cartridge D is laid on the guide shaft 24, and inserted along the shaft 24, so that the guide pin 27*f* of cartridge D is entered into the hook interlock grooves $9d_1$, as shown in FIG. 19A. Then, if the ink sheet cartridge D is rotated in a direction of arrow c around the guide pin 27*f* interlocked into the interlock groove $9d_1$, an interlock projection $27b_4$ as an engagement portion formed on the end portion of ink sheet cartridge D is locked into latch means 38 as an engagement means provided on a rotation end portion of the recording cover 9, as shown in FIG. 19B. Note that if the ink sheet cartridge D is rotated in the direction of arrow c as indicated in FIG. 19A, interlock pins $27b_7$ projecting from side plates $27b_2$ of the second body 27*b* (see FIG. 4) are interlocked with L-shaped arms 24*a*, which are rotated together with the ink sheet cartridge D in the direction of arrow c. Therefore, for example, in exchanging the recording sheet 1, the guide shaft 24 does not interfere with the recording cover 9 being opened.

When the ink sheet cartridge D is removed from the recording cover 9, the latch means 38 is unlocked, in opposite way as above described. Note that the lock latch 38 is locked if the ink sheet cartridge D is pressed against the latch 38, as will be described later, and unlocked if pressed again, in which locking and unlocking can be easily performed by one hand. If the ink sheet cartridge D unlocked as above is rotated around the guide pins 27*f* up to a predetermined position, the L-shape arms 24*a* are contacted with the stoppers $9d_2$ and stopped therein, as shown in FIG. 19A. Therefore, even when the ink sheet cartridge D is slipped off the hand carelessly, the ink sheet cartridge D loaded between a ceiling plate of recording sheet 9 and the guide shaft 24 does not drop off the recording cover 9 because it is supported by the guide shaft 24. If the ink sheet cartridge D is drawn off along the guide shaft 24 from the state as shown in FIG. 19A, it can be easily detached.

As above described, either of loading and unloading the ink sheet cartridge D can be accomplished by sliding it along the guide shaft 24, and rotating it around the guide pins 27*f* interlocked into the hook interlock grooves $9d_1$, so that loading and unloading the cartridge D can be easily performed by one hand.

Latch Means

Figure 20:
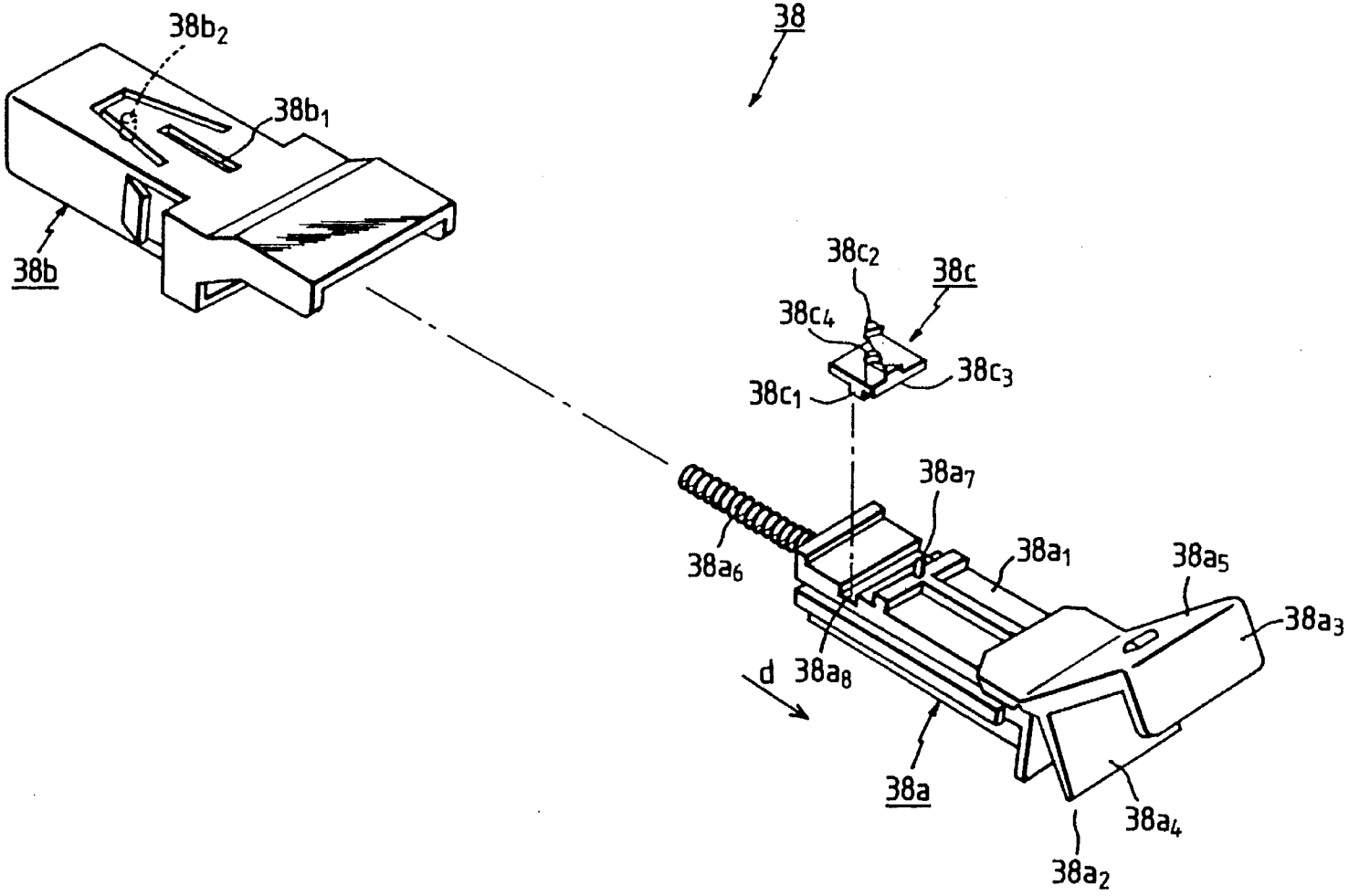
FIG. 20 is an exploded explanation view of parts for latch means.

The latch means 38 is composed of a hook member 38*a*, a case member 38*b* and an interlock piece 38*c*, as shown in FIG. 20.

The hook member 38*a* has a hook portion $38a_2$ rotatably attached via a thinner wall section at a top end of a slide portion $38a_1$. The hook portion $38a_2$ consists of a first interlock portion $38a_3$ and a longer second interlock portion $38a_4$ having a ⊐-shaped cross section formed via a back plate portion $38a_5$, the hook portion $38a_2$ being urged in a direction of arrow d, as indicated in FIG. 20, by a coil spring $38a_6$. Also, at predetermined positions of the slide portion $38a_1$, an interlock projection $38a_7$ and a slide groove $38a_8$ are provided.

Into the slide groove $38a_8$ is fitted a slide projection $38c_1$ of the interlock member 38*c*, which is slidably attached along the slide groove $38a_8$, in which state the slide portion $38a_1$ is inserted into the case member 38*b*, and the interlock projection $38a_7$ is forcedly fitted into a long hole $38b_1$ provided on the case member 38*b* so as to be placed in a securely held state.

Accordingly, the hook member 38*a* is slidable in a range where the interlock projection $38a_7$ is interlocked into the long hole $38b_1$, and always urged in the direction of arrow d as indicated in FIG. 20 by the coil spring $38a_6$. And if the hook member 38*a* is pushed once against a biasing force of the coil spring $38a_6$, the interlock piece 38*c* is interlocked with an interlock projection $38b_2$ protruded from within the case member 38*b*, and thereby locked therein, and if pushed once more, it can be unlocked.

The constitution for locking and unlocking will be described in the following. The interlock piece 38*c* is formed with guide protrusions $38c_2$, $38c_3$, as shown in FIGS. 20 and 21, as well as an interlock protrusion $38c_4$, and further formed with guide protrusions $38c_5$, $38c_6$. And the interlock piece 38*c* attached to the hook member 38*a* is always urged in a direction of arrow e as indicated in FIG. 21 by the coil spring $38a_6$.

Figures 21A, 21B, 21C, 21D, 21E, 21F, 21G:
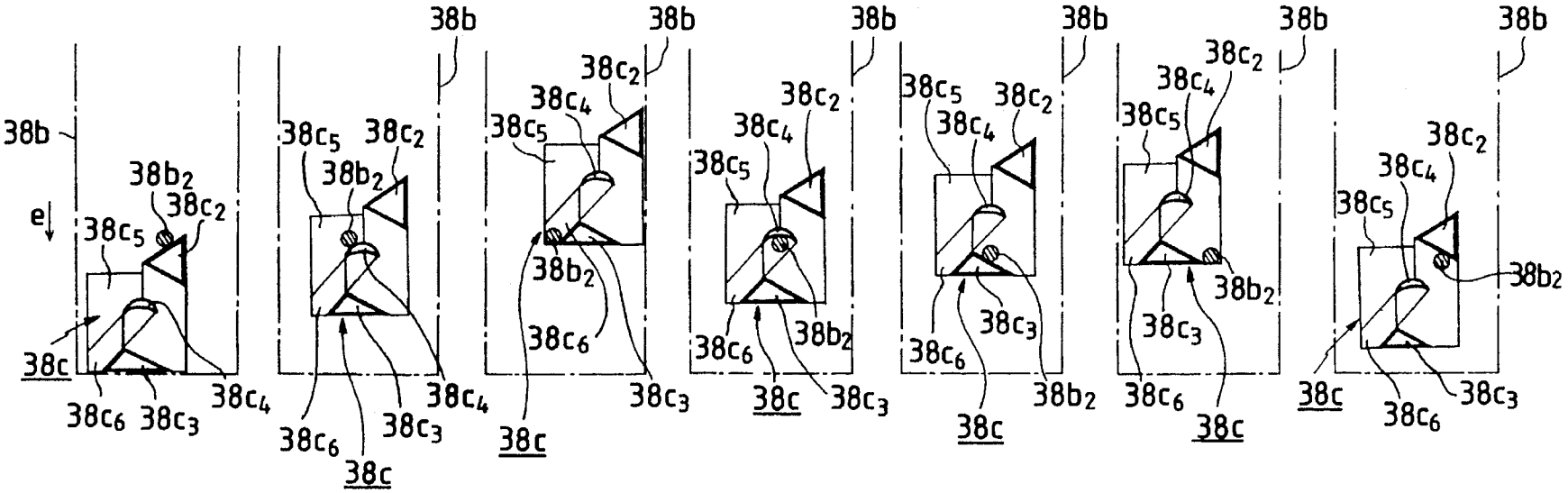
FIG. 21A to 21G are views constitutional explanation views for locking and unlocking of the latch means.

If the hook member 38*a* is pressed in the above state, the relation between the interlock projection $38b_2$ and the interlock piece 38*c* in the state of FIG. 21A is displaced along the guide protrusion $38c_2$, interlock protrusion $38c_4$ and guide recess $38c_6$ as shown in FIG. 21B and 21C. And if pressing of the hook member 38*a* is released in the state of FIG. 21C, the interlock piece 38*c* is displaced along the guide recess $38c_6$, and the interlock projection $38b_2$ is interlocked with the interlock protrusion $38c_4$ as shown in FIG. 21D. That is, it is placed into the locked state by one push.

Next, if the hook member 38*a* is pressed again from the state of FIG. 21D, the relation between the interlock projection $38b_2$ and the interlock piece 38*c* as shown in FIGS. 21E and 21F is displaced along the guide protrusion $38c_3$, and if pressing is released in the state of FIG. 21F, it is displaced along the guide protrusion $38c_2$, as shown in FIG. 21G, and returns to the state of FIG. 21A. That is, it is placed into the unlocked state by one push.

Accordingly, as shown in FIG. 19A, if the ink sheet cartridge D is rotated in a direction of arrow c around the guide pins 27*f*, the interlock projection $27b_4$ of the cartridge D is contacted with a second interlock portion $38a_4$ of the latch means 38 by passing over a first interlock portion $38a_3$, pressing the lock member 38*a* into the case member 38*b*, and placing the latch means 38 into the locked state as shown in FIG. 19B. Thereby, the ink sheet cartridge D is loaded into the recording cover 9. This latch means 38, which has a holding power of about 1 kg in the locked state, can securely hold the ink sheet cartridge D (the weight of ink sheet cartridge D is about 0.8 kg in this example) in the state of FIG. 19B.

If the ink sheet cartridge D is pressed again in a direction toward the recording cover 9, the latch means 38 is unlocked, thereby making the ink sheet cartridge D releasable from the recording cover 9 as shown in FIG. 19A.

By using the latch means 38, it is possible to lock with only one interlock projection $27b_4$ provided on the ink sheet cartridge D, in which the degree of freedom in designing the cartridge D can be increased, and the lock and unlock operations can be easily performed by one hand. The latch means 38 is clicked by one push in lock or unlock operation, so as to easily notify of locking or unlocking Fixing of Recording Cover As previously described, when the recording cover 9 is closed with the ink sheet cartridge D loaded therein, the cover 9 is fixed to the apparatus body 6 so as not to move in forward and backward directions.

That is, the recording system A in this example uses that multi-print method, in which the recording is performed by conveying the recording sheet 1 and the ink sheet 2 in opposite directions, Accordingly, fused ink is transferred to the recording sheet 2 while normal thermal transfer recording is performed, but if fused ink is stiffened for some reasons, with the recording sheet 1 and the ink sheet 2 being overlapped, a large sticking force may be produced, whereby it is apprehended that the recording cover 9 may be moved in the conveying direction of recording sheet 1.

Thus, in this example, shafts **6*e* are provided on the side walls 6*a*, 6*b* of the apparatus body 6 downstream in the conveying direction of recording sheet 1, as shown in FIGS. 13 and 14. The shafts 6*e* are disposed in parallel relative to the axial direction of the platen roller 3*b*. On the other hand, on both sides of the recording cover 9, a pair of interlock members 9*g* are secured at the positions opposed to the shafts 6*e*. The interlock member 9*g* is formed as a fork shape having a U groove engageable with the shaft 6*e*, the dimension of inner diameter of the U groove $9g_1$ being formed with a predetermined fit tolerance relative to the outer diameter of the shaft 6*e*. A line connecting the centers of the one pair of U grooves $9g_1$ is arranged in parallel to the supply reel 25 and the take-up reel 26. And in closing the recording cover 9 down onto the apparatus body 6, by engagement between the shafts 6*e* and the interlock members 9*g* which constitute pairs of connection means, the recording cover 9 can be precisely positioned with respect to the apparatus body 6**, and prevented from moving in forward and backward directions.

Positioning of Supply Reel and Take-up Reel

On the side walls **6*a*, 6*b* of the apparatus body 6 opposed to the bearing grooves $9e_1$, $9e_2$, $9f_1$, $9f_2$ formed in the recording cover 9, supporting members 6*f* are provided as second contact portions for coming into contact with the bearings 28*a*, 28*b*, as shown in FIGS. 13 and 14. And positioning means for each reel 25, 26 can be constituted of the bearing grooves and supporting members. The supporting members 6*f* come into contact with the bearing 28*a*, 28*b* rotatably fitted at both ends of each reel 25, 26, and hold each reel 25, 26 positioned relative to the recording cover 9 by urging the bearings 28*a*, 28*b* toward the bearing grooves $9e_1$, $9e_2$, $9f_1$, $9f_2$. Here, the bearings 28*a*, 28*b* are made of a material with low friction such as polyacetal, polyamide, and polybutylene terephthalate, the supply reel shaft 25*a* and the take-up reel shaft 26*a* being rotatable smoothly while sliding with the inner walls of the bearings 28*a*, 28*b*. The supporting member 6*f* is composed of a case $6f_1$ secured to the side wall 6*a* or 6*b*, a supporting piece $6f_2$ having one end contained in the case $6f_1$ and the other end acting as a contact surface to the bearing 28*a* or 28*b***, and a spring contained in the case $6f_1$.

By the way, the U grooves $27g_1$, $27g_2$ formed on the first body **27*a* and the U grooves $27g_1$, $27g_2$ formed on the second body 27*b* carry loosely the bearings 28*a*, 28*b* therebetween, when the ink sheet cartridge D is assembled by welding the weld zones $27a_1$, $27b_1$ and the weld zones $27a_4$, $27b_6$, respectively, with the first body 27*a* and the second body 27*b* opposed to each other. At this time, as will be clearly seen from FIGS. 5 and 6, the bearings 28*a*, 28*b* are held in a space for fitting the bearing and formed by the U grooves $27g_1$, $27g_2$, with a tolerance of about 2 to 4 mm in a vertical direction and about 0.5 to 1 mm in a width direction, so that the bearings 28*a*, 28*b*** can be swayed.

Thus, when the recording cover 9 is closed, the bearings **28*a*, 28*b*** are biased into the bearing grooves $9e_1$, $9e_2$, $9f_1$, $9f_2$ by the spring, as well as being supported by the supporting pieces $6f_2$ of supporting member $6f_1$, moved rockingly within the space for fitting bearing and formed by the U grooves $27g_1$, $27g_2$, and thereby positioned at predetermined place carried between the supporting members and the bearing grooves.

In this way, each reel 25, 26 is positioned and fixed in forward and backward directions, upward and downward directions, with respect to the recording cover 9, respectively.

Accordingly, with the above constitution, as the bearings **28*a*, 28*b* are rockingly held, dimensional errors of the ink sheet cartridge D are absorbed, thereby eliminating the need of strict positional accuracy of the bearings 28*a*, 28*b***, so that the ink sheet cartridge D can be manufactured at lower cost.

It should be noted that the form of holding rockingly the bearings **28*a*, 28*b* is not limited to the above one in which the bearings 28*a*, 28*b* are held with plays within the spaces for fitting bearing, but the bearings 28*a*, 28*b*** can be held rockingly using elastic body, for example.

Also, when sliding frictional resistances between both ends of each reel 25, 26 and the supporting members **6*f* and bearing grooves $9e_1$, $9e_2$, $9f_1$, $9f_2$ are low, the above bearings 28*a*, 28*b* are not necessarily required, but both ends of each reel 25, 26** can be rockingly held directly in the frame body.

Unsteadiness of Ink Sheet Cartridge

When the ink sheet cartridge D is loaded into the recording cover 9, and the latch means 38 is put into the locked state, the bearigns **28*a*, 28*b* are fitted into the reapective bearing grooves $9e_1$, $9e_2$, $9f_1$, $9f_2$ and positioned therein, as shown in FIGS. 13 and 14. When the recording cover 9 with the ink sheet cartridge D loaded therein is closed, the recording head 3*a* attached to the recording cover 9 as shown in FIG. 1 is entered through the window 27*d* into the inside of the cartridge D, the platen roller 3*b* attached to the apparatus body 6 is entered through the window 27*d*, and the reel gears 25*c*, 26*c* mate with the driving gears provided on the apparatus body 6. Accordingly, if the positions of the windows 27*d*, 27*e* with respect to the recording head 3*a* and the platen roller 3*b*, or the positions of the reel gears 25*c*, 26*c*** with respect to the driving gears are incorrect, the ink sheet cartridge D can not be loaded securely.

To that end, since the dimensions of the ink sheet cartridge D loaded into the recording cover 9 are required to be strictly accurate, the rigidity or dimensional accuracy of the ink sheet cartridge, as well as the dimensional accuracy of the loading portion of recording cover 9 for the ink sheet cartridge, must be raised, whereby in this example, the ink sheet cartridge D is constituted to be more or less rockable with respect to the recording cover 9.

That is, as shown in FIG. 19B, in the state where the ink sheet cartridge D is loaded into the recording cover 9, and the latch means 38 is locked, there are provided a clearance $\delta_1$ between the interlock projection $27b_4$ and the second interlock portion $38a_4$, and a clearance $\delta_2$ between the interlock projection $27b_4$ and the back plate portion $38a_5$. Accordingly, the ink sheet cartridge D is rockable with respect to the recording cover 9 by the amounts of clearances $\delta_1$, $\delta_2$. The clearance $\delta_1$ is preferably set to be about 0.2 mm to 0.5 mm, and the clearance $\delta_2$ is preferably set to be about 0.5 mm to 1.5 mm. Note that the clearance $\delta_1$ is set to be 0.2 mm, and the clearance $\delta_2$ is set to be 1 mm in this example.

As previously described, with such constitution that the ink sheet cartridge D is rockable with respect to the recording cover 9, even if there is any error in the loading dimension, its dimensional error will be absorbed by the rocking, so that the ink sheet cartridge D can be securely loaded into the apparatus body 6 or the recording cover 9. Accordingly, the loading dimension can have a certain degree of freedom, so that the management of parts can be made easier, with reduced manufacturing cost, and without increasing the rigidity or dimensional accuracy of ink sheet cartridge D, or requiring higher accurate dimension of the loading portion of recording cover 9 for the ink sheet cartridge.

It should be noted that such effects can allow securer positioning of bearings 28*a*, 28*b*, because the bearings 28*a*, 28*b* are rockingly held in the space for fitting bearing within the ink sheet cartridge D, as previously described.

As above described, the bearings 28*a*, 28*b* are held in the space for fitting bearing formed by the U grooves $27g_1$, $27g_2$, with a tolerance (clearance) of about 2 to 4 mm in a vertical direction, and about 0.5 to 1 mm in a width direction. The reason why the play in the width direction is smaller is to make it easier for the bearings 28*a*, 28*b* to come into contact with the bearing grooves $9e_1$, $9e_2$, $9f_1$, $9f_2$ and the supporting members 6*f* by reducing the movement of bearings 28*a*, 28*b* in the width direction. Under such conditions, the molding accuracy of ink sheet cartridge D is not too high, and when the ink sheet cartridge D is secured to the recording cover 9, the above-mentioned tolerance in the width direction may be too insufficient to absorb the dimensional errors in the width direction of ink sheet cartridge D. However, as above described, with such constitution that the ink sheet cartridge D is rockable relative to the recording cover 9, it is possible to absorb the dimensional errors of ink sheet cartridge D or loading portion which can not be absorbed only with the bearings 28*a*, 28*b* as previously described. Accordingly, the positioning of the bearings 28*a*, 28*b* is made smoother and securer, so that it is possible to further increase the precisions of parallelisms between the supply reel 25 and the take-up reel 26, and between the platen roller 36 and the recording head 3*a*.

Also, in this example, since there are provided clearances between the interlock projection $27b_4$ and the second interlock portion $38a_4$ of latch means 38, and between the interlock projection $27b_4$ and the back plate portion $38a_5$ of latch means 38, in the state where the ink sheet cartridge D is loaded into the recording cover 9 and the latch means 38 is locked, the external force applied to the latch means 38 is only the weight of ink sheet cartridge D, with no unreasonable external force, so that false operation or damage of latch means 38 can be prevented.

Note that the method in which the ink sheet cartridge D is rockable with respect to the recording cover 9 is not limited to the above one, but a constitution can be adopted in which latch means 38 is connected via a leaf spring to the recording cover 9 so as to be rockable with the elastic force of the leaf spring. Also, the rocking can be produced by carrying the ink sheet cartridge D via a coil spring to the recording cover 9.

Also, the latch means 38 is not limited to the above example, but can be constituted to be engageable on the side of the weld zone $27a_4$ in the ink sheet cartridge D.

It should be noted that according to this example, the frame body 27 of the ink sheet may be rockable even after the recording cover 9 is closed onto the apparatus body 6, and when the external force is applied to the frame body 27 of the ink sheet after the recording cover 9 is closed, that external force can be absorbed. On the other hand, since the bearings 28*a*, 28*b* are rigidly positioned between the bearing grooves $9e_1$, $9e_2$, $9f_1$, $9f_2$ and the supporting member 6*f*, they do not become unstable after the recording cover 9 has been closed, whereby high conveying precision of ink sheet can be maintained, and excellent quality of image can be obtained. In this way, the present invention is characterized by including two rockable stages in the bearings and the ink sheet cartridge, which are important constitutional factors indispensable in accomplishing the objects of the present invention.

Recording Constitution

As described above, the thermal transfer recording can be accomplished with recording means 3 having the ink sheet cartridge D loaded therein.

Recording Means

Recording means 3 will be described in the following. The recording head 3*a* is a thermal head having a plurality of heating elements arranged in a row which can generate the heat with energization, wherein it is rockably attached to a head supporting portion 3*c* provided on the recording cover 9 as shown in FIG. 1. Also, the recording head 3*a* is urged toward the platen roller 3*b* by a spring 3*d* disposed between the head 3*a* and the recording cover 9. And with that urging force, the recording sheet 1 and the ink sheet 2 overlapped are pressed against the platen roller 3*b*.

As shown in FIGS. 13 and 14, fork members 3*e* are provided on both sides in a longitudinal direction. The fork members 3*e* have a positioning feature for setting the position of the recording head 3*a* with respect to the platen roller 3*b* by engagement with the shanks $3b_1$ of platen roller 3*b* in loading the ink sheet cartridge D into the recording cover 9.

The platen roller 3*b* is formed with a roller portion $3b_2$, in accordance with the width dimension of recording sheet 1, on both sides of which are formed the shanks $3b_1$.

The platen roller 3*b* is driven by the driving of a platen motor 39 consisting of a stepping motor as shown in FIG. 13. The motor 39 is attached to a side wall 6*a* of the apparatus body 6, its rotational force being transmitted via gears 40*a*, 40*b*, 40*c* to the platen roller 3*b*. In recording onto the recording sheet 1, it is conveyed in a direction of arrow a by rotating the platen roller 3*b* in a direction of arrow f as indicated in FIG. 1, and after being cut by a cutter 4, it is returned in a direction opposite to arrow a by rotating the platen roller 3*b* in a direction opposite to arrow f, thereby being placed in a waiting state.

Take-up Reel Driving Mechanism

In recording, the ink sheet 2 is wound around the take-up reel 26 while the recording sheet 1 is conveyed by the platen roller 3*b*. In this example, the ink sheet 2 is wound around the take-up reel 26 by rotating the take-up reel 26 by means of a driving mechanism 41 provided on the recording cover 9, as shown in FIGS. 13 and 14.

In conventional recording apparatuses using one-time ink sheet, it is common that the driving mechanism for the take-up reel is provided on the side of the apparatus body, in which the general constitution is such that the driving gear is constituted as a pendulum gear so as to easily mate with a reel gear of the take-up reel, and a sliding clutch is disposed in the driving mechanism to transmit the rotation of motor. Therefore, when the tensile force acting on the ink sheet becomes larger, skipping teeth of the pendulum gear at the mating portion, or sliding in the sliding clutch may occur. That is, there is a risk that the rotation of driving motor constituting the driving mechanism may be surely transmitted to the take-up reel.

On the other hand, in the multi-print recording method, image can be formed while the ink is being shorn from within the ink layer, whereby the conveyance of ink sheet 2 will require the force amounting to the frictional force between the ink sheet 2 and the recording head 3 plus the shearing force of ink. Accordingly, the conveyance of ink sheet 2 will require greater force as compared with conventional one-time ink sheet.

Also, in the multi-print recording method, it is necessary to convey the ink sheet 2 by 1/n lines each time image of one line is formed in the recording sheet 1, where n is a positive integer, whereby the quality of record image can be raised by performing the conveyance surely.

In order to satisfy the aforementioned conditions, a take-up reel driving mechanism 41 is provided in the recording cover 9, in this example, so that the driving force is surely transmitted to a take-up reel gear 26*c* of the ink sheet cartridge D loaded into the cover 9.

Figure 22:
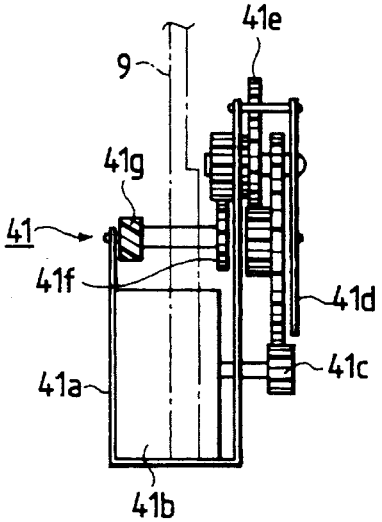
FIG. 22 is an explanation view showing a constitution for transmission of driving force to a take-up reel.

That constitution is such that on a side face (right side face in this example) of the recording cover 9 is secured a bracket 41*a*, as shown in FIG. 22, to which an ink sheet motor 41*b* consisting of a stepping motor is fixed. A shaft of the motor 41*b* has a motor gear 41*c* mounted therein, and the bracket 41*a* has a first reduction gear 41*d*, a second reduction gear 41*e* and a third reduction gear 41*f* formed integrally with a driving gear 41*g*, which are mounted rotatably and with predetermined axial distances between gears. Accordingly, the rotation of the ink sheet motor 41*b* is reduced via the reduction gears 41*d*, 41*e*, 41*f* from the motor gear 41*c*, and transmitted surely to the driving gear 41*g* mating with the reel gear 26*c* of the take-up reel 26.

Accordingly, with the driving of the take-up reel driving mechanism 41, it is possible to convey the ink sheet 2 at predetermined conveying speed and reliably.

Back Tension Adding Mechanism

The ink sheet 2 is drawn from the supply reel 25 by the take-up reel 26 rotating with the driving mechanism 41, and wound around the take-up reel 26, in which the ink sheet 2 drawn out from the supply reel 25 is subjected to a fixed back tension added by a back tension adding mechanism.

The back tension adding mechanism 42 is constituted of a rotation plate 42*b* rotatably mounted around a rotational fulcrum 42*a* on side wall of the apparatus body 6, a sliding clutch 42*d* secured to the rotation plate 42*b* and connected to a tension gear 42*c*, and a tension spring 42*e* for urging the rotation plate 42*b* upward.

In the back tension adding mechanism 42 constituted as above, when the recording cover 9 with the ink sheet cartridge D loaded therein is closed, the reel gear 25*c* of the supply reel 25 mates with the tension gear 42*c*. And if the ink sheet 2 wound around the supply reel 25 is drawn out, the reel 25 is rotated with the rotational load of the sliding clutch 42*d*, thereby subjecting the ink sheet 2 drawn out to the back tension.

Thrust of Reel Gear

As described above, driving by the ink sheet motor 41*b*, the ink sheet 2 is wound around the take-up reel 26 while being subjected to the back tension, in which a fixed amount of thrust is exerted in the axial direction onto the supply reel 25 and the take-up reel 26.

In general, when the positioning in plural directions is performed with one operation, the skill in operation may be required, but in office equipments such as a recording apparatus, it is difficult to demand the operational skill. Therefore, in conventional recording apparatuses, there is provided more or less clearance or looseness in the axial direction of each reel, in order to facilitate the loading of the take-up reel and the supply reel into the recording cover. However, the looseness with each reel may cause oblique movement in the ink sheet conveyed during the forming of image, thereby causing jamming. To prevent the looseness, spring means for applying the lateral pressure to the supply reel and the take-up reel may be required, but the number of parts is increased.

In this example, if the recording cover 9 with the ink sheet cartridge D loaded therein is closed, the forward or backward position as well as upward or downward position is set by the bearing grooves $9e_1$, $9e_2$, $9f_1$, $9f_2$ and the supporting members 6*f*, and by acting the axial thrust onto each reel 25, 26, left or right position can be set, thereby preventing positional deflection in the left or right direction.

With that constitution, when the recording cover 9 is closed as above described, the reel gear 25*c* of the supply reel 25 in the ink sheet cartridge D mates with the tension gear 42*c* of the back tension adding mechanism, while the reel gear 26*c* of the take-up reel 26 mates with the driving gear 41*g* of the driving mechanism 41.

The reel gear 25*c*, 26*c* of each reel 25, 26 is constituted by a helical gear, and the tension gear 42*c* and the driving gear 41*g* mating with the reel gears 25*c*, 26*c* are also constituted by helical gears.

Figure 23:
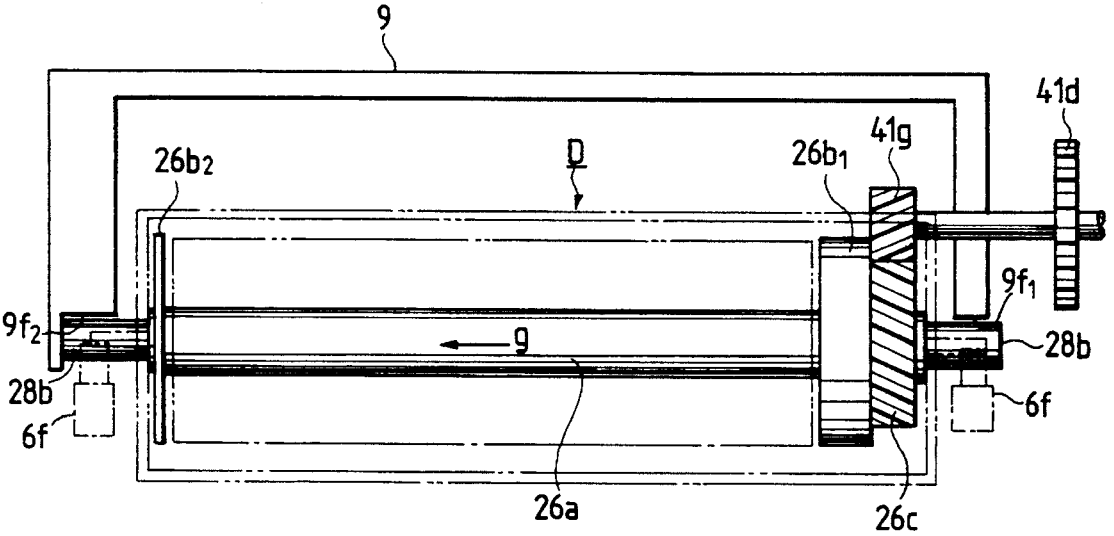
FIG. 23 is a view for explaining the thrust with a helical gear.

Taking the take-up reel 26 as an example, by causing the reel gear 26*c* to mate with the driving gear 41*g* on the side of the recording cover 9 as shown in FIG. 23, and exerting a rotational force to the driving gear 41*g*, the thrust on the take-up reel 26 is produced in a direction of arrow g as shown in FIG. 23.

Also, the relation between the reel gear 25*c* of the supply reel 25 and the tension gear 42*c* mating therewith is similar to that when the supply reel 25 is rotated by drawing out the ink sheet 2, the thrust is produced in the same direction as that for the take-up reel 26 upon the rotational force acting on the tension gear 42*c*.

Therefore, during the conveyance of ink sheet, each reel 25, 26 is always urged toward the bearing grooves $9e_2$, $9f_2$ formed on the recording cover 9, so that each reel 25, 26 is not deflected in the axial direction during the conveyance of ink sheet 2.

Cartridge and Identification of n Value

When the recording is performed by loading the ink sheet cartridge d having the constitution as above described, whether or not the ink sheet cartridge D loaded prior to the recording exists, the size of ink sheet 2 and the recording n value are determined in this example.

Figure 24:
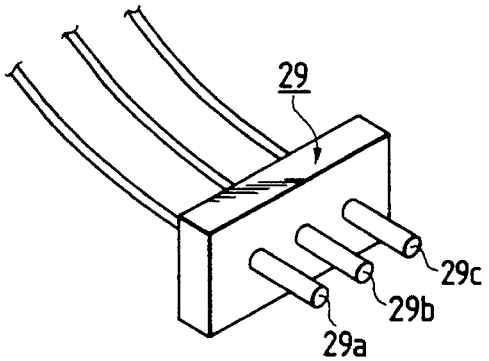
FIG. 24 is an explanation view of a microswitch.

For that purpose, as shown in FIGS. 13 and 14, a microswitch 29 is attached at a position opposed to the identification pieces $27i_1$, $27i_2$, $27i_3$, in order to serve as detection means for detecting the presence or absence of cartridge and the kind of ink sheet 2, when the ink sheet cartridge D is loaded. This microswitch 29 has three actuators coming into contact with the respective identification pieces $27i_1$, $27i_2$, $27i_3$, as shown in FIG. 24, in such a way that when the ink sheet cartridge D is loaded, the identification pieces $27i_1$, $27i_2$, $27i_3$ can press on first, second and third switches 29*a*, 29*b*, 29*c*, correspondingly, so that each switch is turned on with the above pressing.

With the apparatus of this example, the first switch 29*a* detects whether or not the ink sheet cartridge D exists, the second switch 29*b* detects the size of ink sheet 2 contained in the cartridge D, among B4, A4 and letter sizes, and the third switch 29*c* detects the recording n value. Accordingly, if the ink sheet cartridge D is loaded into the recording cover 9 by cutting away each identification piece $27i_1$, $27i_2$, $27i_3$ in accordance with the ink sheet size or recording n value, each switch 29*a*, 29*b*, 29*c* is selectively turned on so that the size of ink sheet can be detected.

The detection operation of the switch 29 will be now described.

Figure 25:
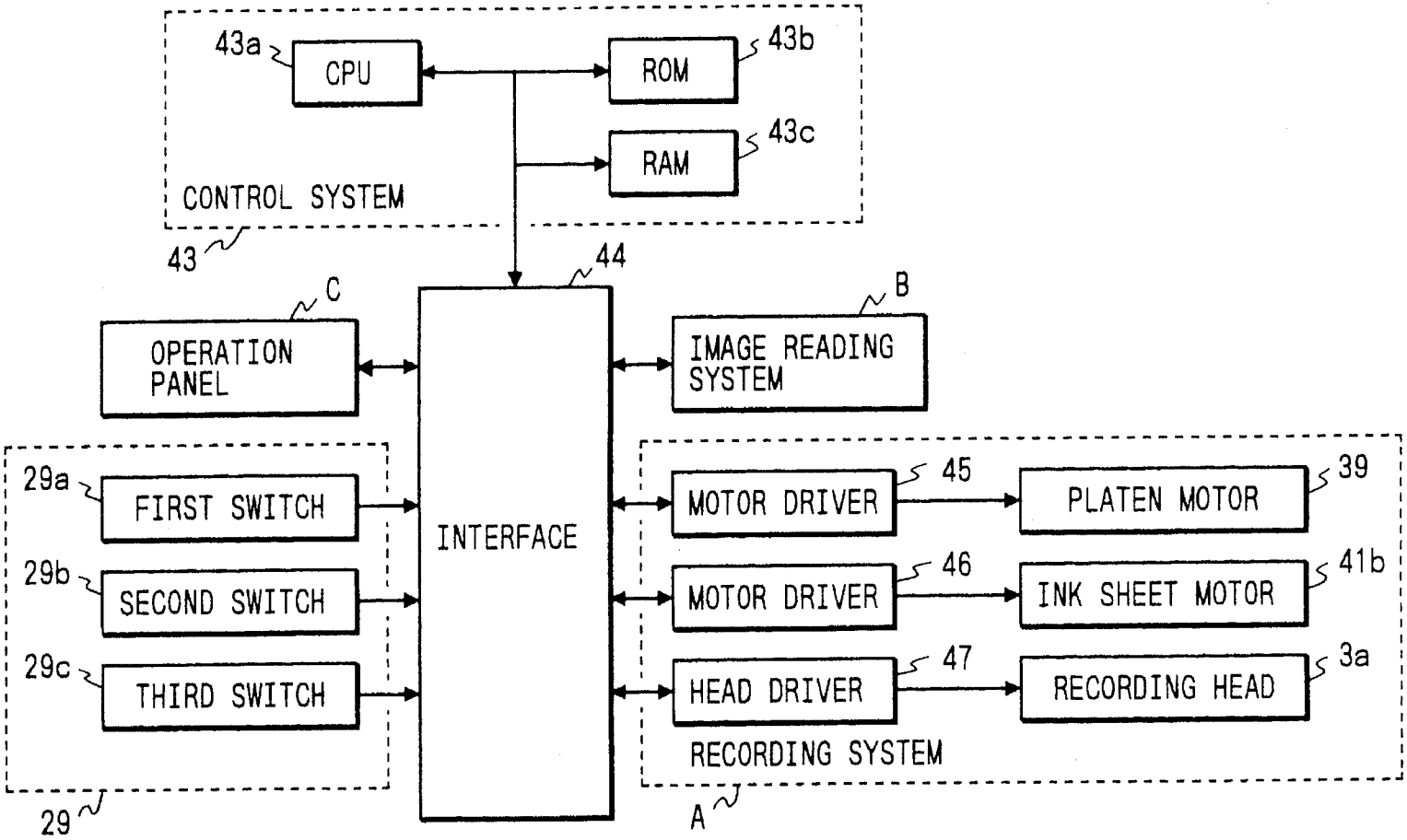
FIG. 25 is a block diagram of a control system.

FIG. 25 is a block diagram of the control system for the apparatus, principally for the recording system A and the switch 29, wherein 43 is a control system, consisting of CPU 43*a*, ROM 43*b* and RAM 43*c*.

The CPU 43*a* is a central processing unit for reading programs or various data from an operation panel or the ROM 43*b* as will be described later, and performing necessary operations or decisions, and various controls.

The ROM 43*b* is a read only memory for storing various programs or data necessary for recording such as character codes, dot patterns.

The RAM 43*c* is a random access memory, consisting of working area for storing temporarily data being instructed by the CPU 43*a* or operation results, buffer area for storing temporarily various data input from the operation panel C, and text area for storing documents.

The control system 43 inputs image signals transmitted from the reading system B or instruction signals from the operation panel C via an interface 44, as well as detection signals from the microswitch 29. And the control system 43 outputs driving signals to motor drivers 45, 46 for driving a platen motor 39 and an ink sheet motor 41*b*, respectively, and further outputs driving signals to a head driver 47 for driving a recording head 3*a*.

Figures 26, 26A:
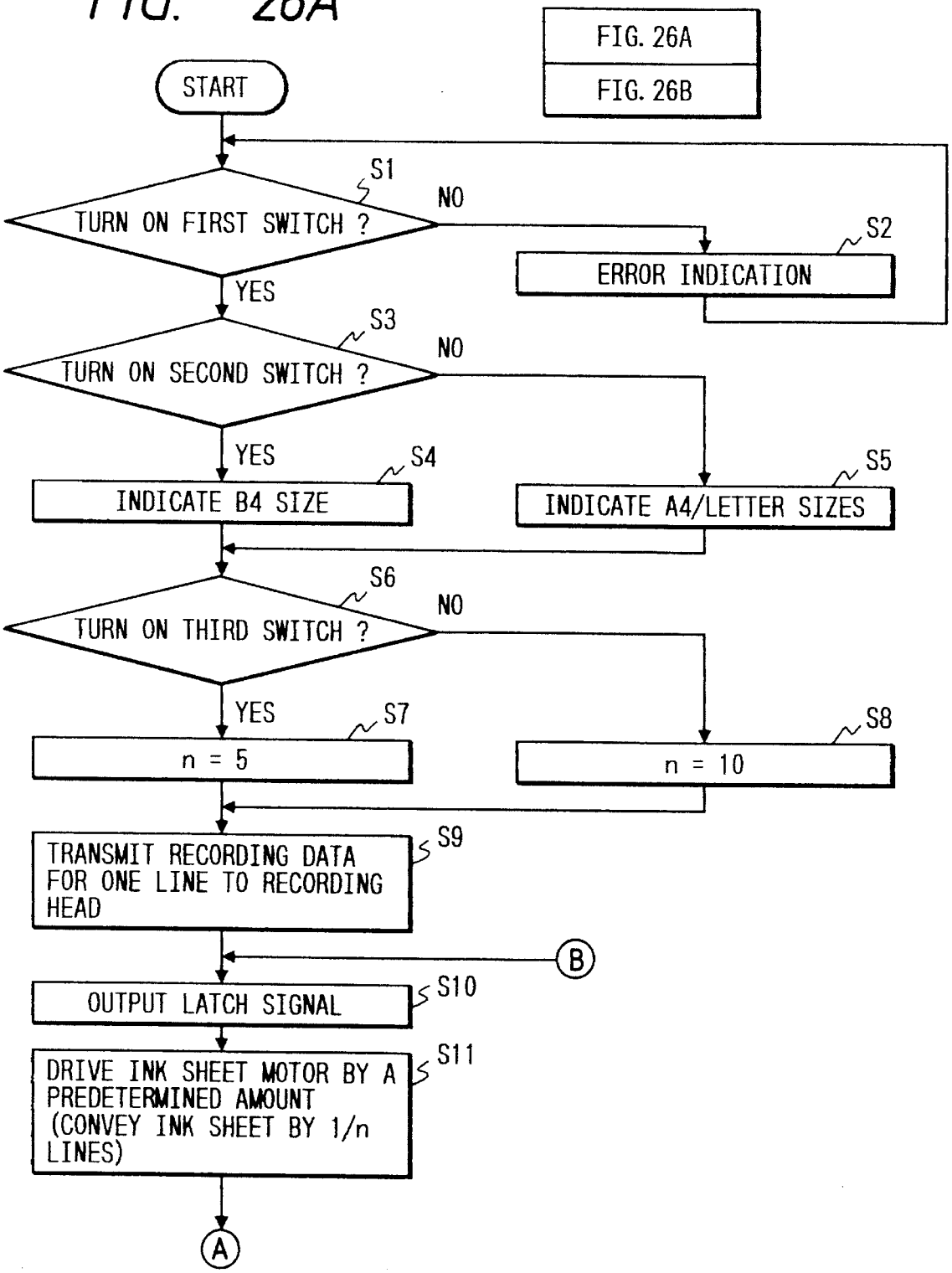
Figure 26B:
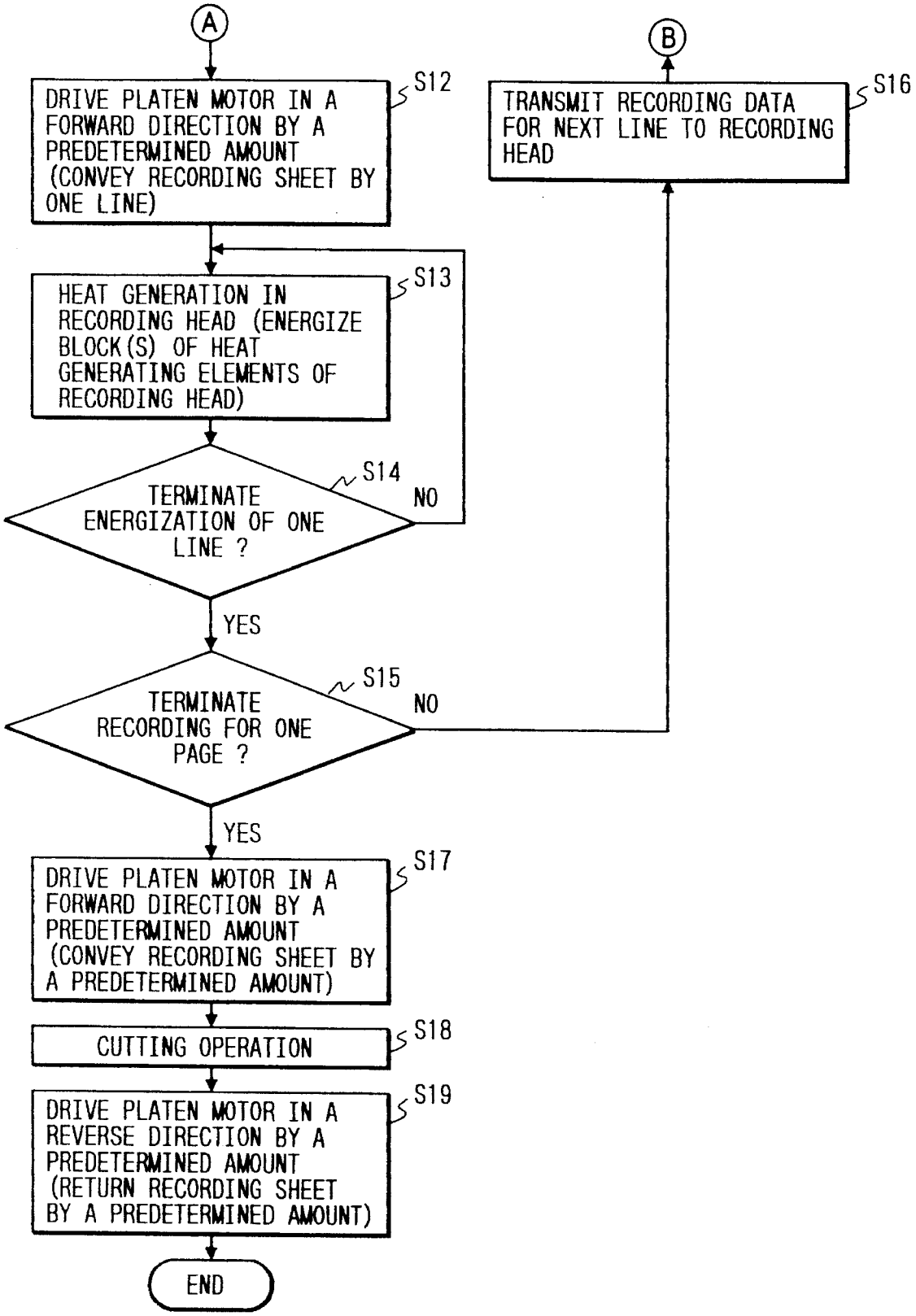

In recording in accord with signals from the control system 43, the procedure for controlling and recording by detecting the size of ink sheet 2 or the recording n value is performed in accordance with a program as represented in a flowchart of FIG. 26.

That is, as shown in FIG. 26, if the recording is executed with the ink sheet cartridge D loaded, firstly, a decision is made at step S1 whether or not the first switch 29*a* of microswitch 29 is turned on, and if not, the procedure proceeds to step S2, because no ink sheet cartridge D is loaded, where an error indication "INSPECT CARTRIDGE" is displayed on a liquid crystal display unit provided on the operation panel C.

If the first switch 29*a* is turned on at step S1, the processing proceeds to step S2, where a decision is made whether or not the second switch 29*b* is turned on. If the second switch 29*b* is turned on, the procedure proceeds to step S4, where an indication "B4" is displayed on the liquid crystal display unit because the ink sheet 2 within the ink sheet cartridge is of B4 size, while if the second switch 29*b* is off, the procedure proceeds to step S5, where an indication "A4/LETTER" is displayed on the liquid crystal display unit because the ink sheet 2 is of A4 or letter size.

Next, at step S6, a decision is made whether or not the third switch 29*c* is turned on. If the third switch 29*c* is turned on, the procedure proceeds to step S7, where the recording n value is set at n=5 (number of steps per line for ink sheet motor 41*b*=2), while if the third switch 29*c* is not turned on, the procedure proceeds to step S8, where the recording n value is set at n=10 (number of steps per line for ink sheet motor 41*b*=1).

Next, proceeding to step S9, recording data for one line is output to the recording head, and if the recording data has been transmitted, a latch signal is output at step S10 to store the recording data for one line into a latch circuit of head driver 47.

And at step S11, the ink sheet motor 41*b* is driven to convey the ink sheet 2 by 1/n lines in a direction of arrow b. Further, at step S12, the platen motor 39 is driven to convey the recording sheet 1 by one line in a direction of arrow a as indicated in FIG. 1. Note that the one line as above mentioned is a length corresponding to the length of one dot recorded by the recording head 3*a*.

Next, proceeding to step S13, each block of heat generating elements of recording head 3*a* is energized (heat generation of the recording head 3*a* is performed for each block of heat generating element line, which is divided into several blocks). Note that the energization is performed with the heat control (energization pulse width control) in accordance with the recording n value. At step S14, decision is made whether all blocks of heat generating element line for the recording head 3*a* have been energized, in which if the recording for one line has not been terminated, the procedure returns to step S13, while if the recording for one line has been terminated, the procedure proceeds to step S15, where a decision is made whether or not the recording for one page has been terminated. If the recording for one page has not been terminated, the procedure proceeds to step S16, where recording data for next line is transmitted to the recording head 3*a*, and returns to step S10.

At step S15, if the recording for one page has been terminated, the procedure proceeds to step S17, where the platen motor 39 is driven by a predetermined amount so as to convey a trailing end of image on the recording sheet 1 to a position of cutter 4, and at step S18, the cutter 4 is operated to cut the recording sheet 1. And at step S19, t:he platen motor 39 is driven in a reverse direction to return a leading end of recordnig sheet within the apparatus to a pressed position between recording head 3*a* and platen roller 3*b*, and wait for the recording of next page.

As above described, by identifying an optimal recording n value for ink sheet 2 within the ink sheet cartridge D loaded in recording, with the microswitch 29, and performing the automatic operation of conveying the ink sheet 2 or controlling the heat generation of recording head 3*a*, optimal record images can be obtained without the need of an operator for setting up the mode.

Prevention of Entrainment of Recording Sheet

As above described, the recording sheet 1 having a certain image recorded is cut at a trailing end of the image by the cutter 4, and the cut recording sheet 1 is exhausted out of the apparatus by means of a pair of exhausting rollers 5*a*, 5*b*. On the other hand, as to the recording sheet within the apparatus, in order to eliminate a blank in a leading end portion in recording for a next page, the platen motor 39 is driven in a reverse direction so as to return the leading end portion of the recording sheet 1 from the position of the cutter 4 to a nip position between recording head 3*a* and platen roller 3*b*. At this time, if there is a large space between the platen roller 3*b* and an edge portion of window 27*e* of the cartridge D in a rear portion of the platen roller 3*b*, the recording sheet 1 may be folded and entrained into the cartridge D, thereby producing some creases on the recording sheet 1 and possibly causing jamming at the next recording.

In this respect, the ink sheet cartridge D in this example is provided with a small space between the platen roller 3*b* and the edge portion of window 27*e* because a guide member 31 for recording sheet 1 has been pasted onto the cartridge D as shown in FIG. 1. Accordingly, the recording sheet 1 is not entrained into the cartridge D in conveying it in the reverse direction, so that no creases may occur.

Figure 27:
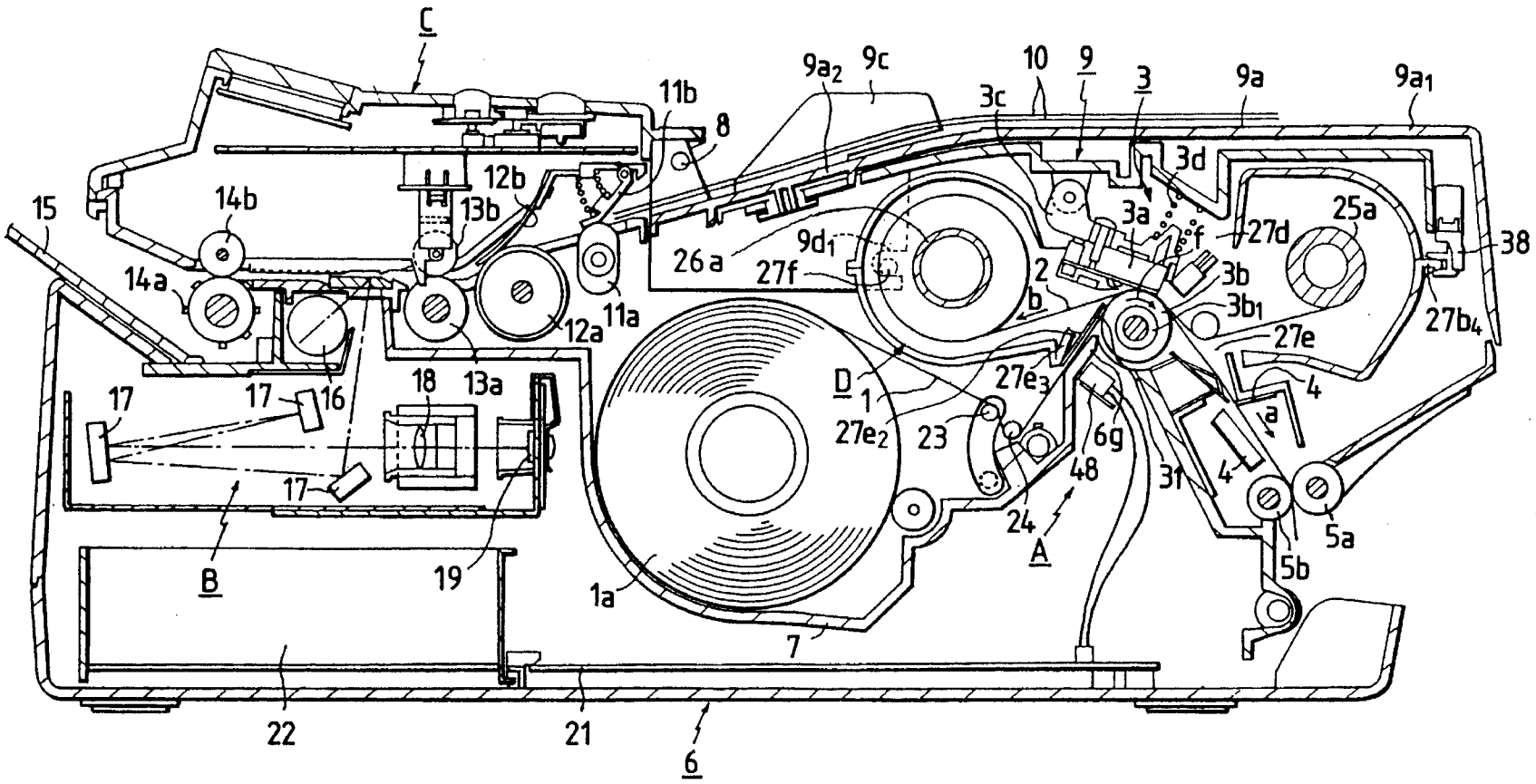
FIG. 27 is an explanation view showing a completion state of winding an ink sheet.

Note that the guide member 31 is arranged not to touch on the ink sheet 2 even when the ink sheet 2 is substantially wound around the take-up reel 26 or immediately before the completion as shown in FIG. 27. However, this is true with the state where the recording cover 9 is closed in the apparatus body 6 and the tension is applied to the ink sheet 2, but in other states, it does not matter if the guide member 31 may touch on the ink sheet 2.

Also, in this example, the guide member 31 is constructed by pasting a Mylar onto the second body **27*b*, but this guide member 31 may be constituted as a part of the frame 27. However, to avoid damaging of the sheet 2 when in contact with the ink sheet 2**, it is preferably constructed of an elastic member such as Mylar or polyester.

Reflecting Portion of Recording Sheet Detection Sensor

This apparatus is constituted in such a manner that when the recording sheet 1 has been used up during recording, it detects the absence of recording sheet 1, and displays its indication on the liquid crystal display unit. Therefore, on the conveying passage of recording sheet 1 and between the guide shaft 24 and the platen roller **3*b* is provided a recording sheet detection sensor 48**.

In this example, the recording sheet detection sensor 48 is constructed of a reflection-type optical sensor, in which the light from a luminous element of the sensor 48 is reflected at the recording sheet 1 passing between a slant plane at the edge portion of the window **27*e* formed in the second body 27*b* and a slant plane 6*g* formed in the apparatus body 6, and led to a light receiving element. That is, a plane of luminous element for the sensor 48 and that of recording sheet 1 guided by the guide member 31 are made substantially in parallel to each other, whereby the light emitted from the luminous element is reflected from the recording sheet 1** and reliably led to the light receiving element.

When there is no recording sheet 1, the light from the luminous element is reflected at the slant plane $27e_2$ on edge portion of the cartridge D, wherein its difference from the quantity of light as reflected at the recording sheet 1 is detected in the voltage level, and thereby, the presence or absence of recording sheet 1 can be detected.

Here, if the plane of the luminous element for the sensor 48 and the slant plane on edge portion of the cartridge D are parallel, the detected voltage level at that time is not largely different from that when recording sheet 1 exists, in which the difference is difficult to detect. Therefore, in this example, a reflecting surface $27e_3$, which is a part of the slant plane $27e_2$ on edge portion and onto which the light from the luminous element of the sensor 48 impinges in the cartridge D to be reflected therefrom, as shown in FIG. 6, is not pasted with the sheet guide member 31, but is constituted to have a different inclination angle from other slant plane $27e_2$ on edge portion.

Figure 28:
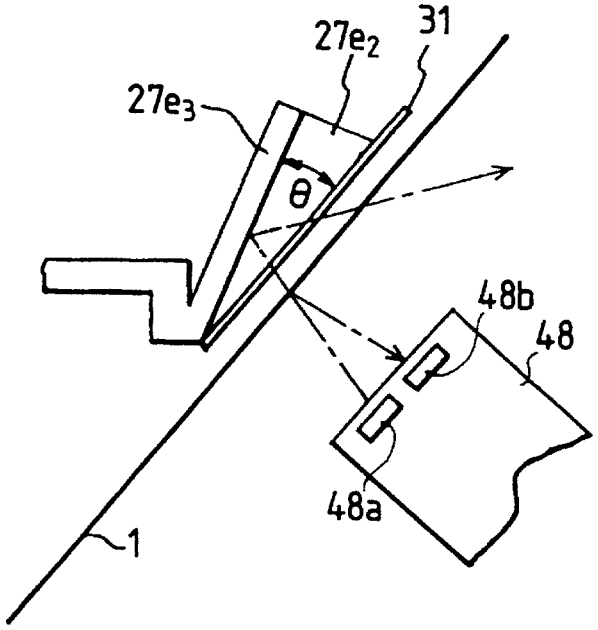
FIG. 28 is an explanation view of the light reflection in a recording sheet detection sensor.

In this example, the inclination angle of reflecting surface $27e_3$ is set to be $\theta=5°$ for the guide member 31 which is substantially parallel to the recording sheet 1 to be conveyed as shown in FIG. 28. Note that the angle $\theta$ is preferably set in a range from 1° to 90°, and more preferably from 5° to 30°.

As above described, by providing the inclination angle on the reflecting surface $27e_3$, the light from the luminous element **48*a* of sheet detection sensor 48 is reflected at the reflecting surface $27e_3$, so that the light receiving element 48*b* does not receive almost any light. Therefore, a manifest difference will arise between the voltage levels of the light receiving element 48*b* when reflected at the recording sheet 1 and when reflected at the reflecting surface $27e_3$ without recording sheet 1, so that the presence or absence of recording sheet 1** can be surely detected for recording.

Handset and Ink Sheet Motor

The relation between handset and motor in the facsimile terminal equipment as previously described will be described in the following.

It is common that the facsimile terminal equipment is provided with a handset 20 for communication on telephone. In this example, the handset 20 is provided on the opposite side to the take-up reel driving mechanism 41. That is, the take-up reel driving mechanism 41 is provided on the side wall **6*a* of the apparatus, while the handset 20 is provided on the side wall 6*b*** of the apparatus.

The handset 20 is connected to a NCU (Network Control Unit) 49 within the apparatus via a curl code **20*a*. And the NCU is connected to a telephone line 20*b***, in which it makes the transmission or reception operation in the facsimile mode, and calling or called operation in the telephone mode.

As the NCU 49 is composed of various electrical parts, thereby being easily subject to the influence of noises, it is preferable to locate the NCU 49 far away from parts of noise source such as ink sheet motor **41*b*. Generally, the operator takes the handset 20 by his left hand, and operates the dial by his right hand in normal operation, and in view of that, it is preferable to dispose the handset 20 and the NCU 49 on the left side wall 6*b* or front side. Therefore, in this example, the ink sheet motor 41*b* is disposed on the right side wall 6*a* or back side which is the side of the apparatus opposite to the handset, in order to be located far away from the handset 20 and the NCU 49. Thereby, the NCU 49 is not subjected to the influence of ink sheet motor 41*b***, thereby enabling the normal communication or service.

It should be noted that in this example, the platen motor 39 is also disposed on the right side wall **6*a*, as shown in FIG. 13, so as to remove the influence of noises to the NCU 49**.

Other Examples

Other examples for each portion in the ink sheet cartridge D and the recording apparatus as previously described will be now described in the following.

Ink Sheet Slack Prevention Member

In the aforementioned examples, to prevent the slack of ink sheet 2, a sponge 30 is placed in contact with a part of the flange $25b_1$ of the supply reel 25, as shown in FIG. 8, wherein the sponge 30 may be pasted continuously, or intermittently in several divisions around the periphery of the flange $25b_1$.

Figure 29:
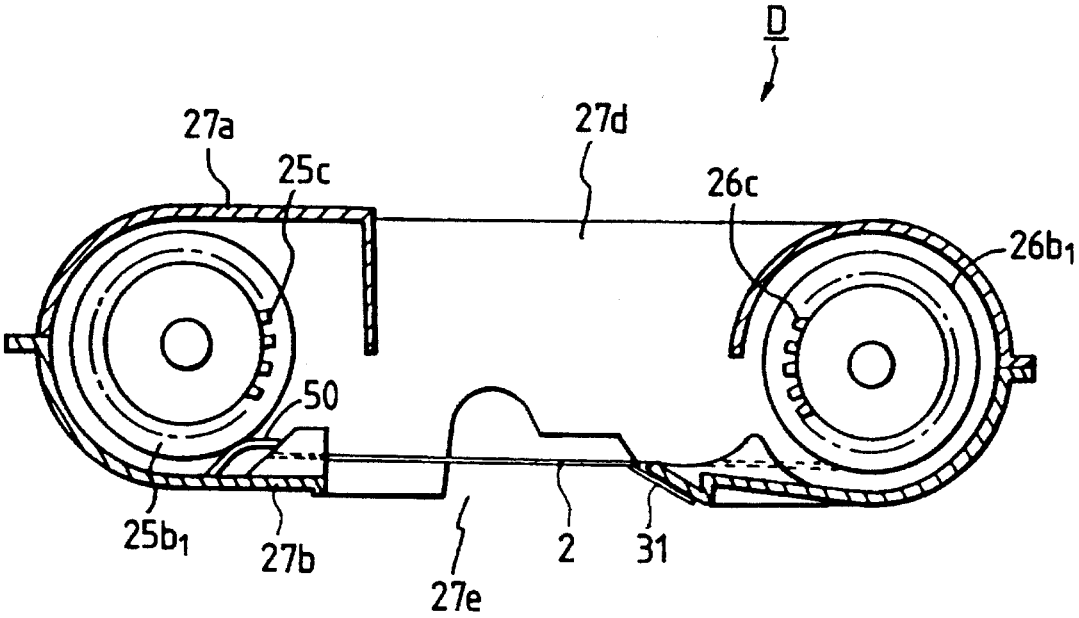
FIG. 29 is an explanation view showing another example for an ink sheet slack preventing constitution.

Also, instead of using the sponge, with a constitution of integrally providing an elastic member 50 having less permanent deformation on the second body **27*b* and pressing the elastic mebmer 50 against the flange $25b_1$ of the supply reel 25, as shown in FIG. 29, it is possible to prevent the slack of ink sheet 2 by removing idle running of the supply reel 25. As previously described, by integrally forming the second body 27*b*** and the elastic member, the number of parts can be reduced and the assembly is made simpler, resulting in reduced cost.

Also, the slack prevention member for ink sheet 2 may be pressed against any of the flanges $25b_2$, $26b_1$, $26b_2$, rather than the flange $25b_1$. However, it is more effective that the slack prevention member may be provided at a position not to interfere with the supporting members **6*f* where its reaction force is not produced as shown in FIG. 13, when the recording cover 9 is closed with the ink sheet cartridge D loaded therein, or a position where the slack prevention member is pressed against the flange by the weight of the take-up reel 26, i.e., on the side of the second body 27*b***.

Idle Running Prevention Stopper for Reel Gear

Figure 30:
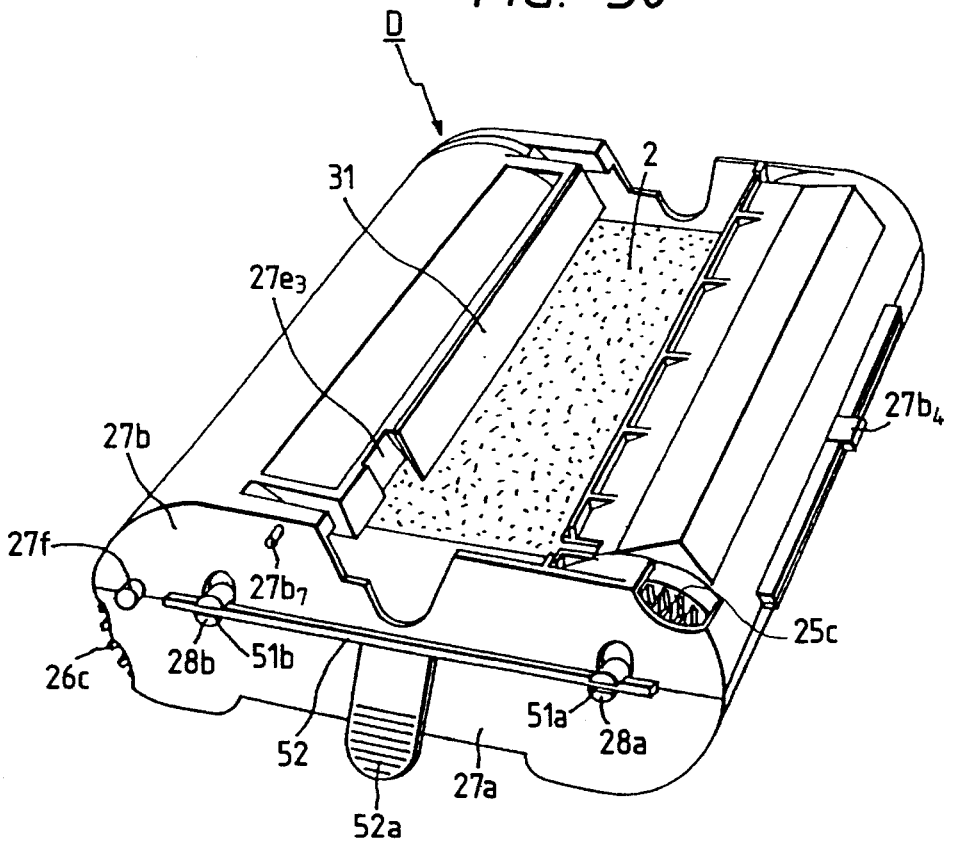
FIG. 30 is an explanation view showing another example for preventing the run idle of supply reel and take-up reel.

While in the previous example, the stopper 32 is interlocked with the reel gears 25*c*, 26*c* as shown in FIGS. 8 and 9, so that the supply reel 25 and the take-up reel 26 may not be rotated idly in transporting the ink sheet cartridge D, the idle running prevention member can take a form, for example, in which notches 51*a*, 51*b* are provided in the bearings 28*a*, 28*b*, and recesses are provided in the reel shafts 25*a*, 26*a* corresponding to the notches 51*a*, 51*b*, as shown in FIG. 30, rather than interlocking the reel gears 25*c*, 26*c*. And by inserting an insertion member 52 from the notches 51*a*, 51*b* into the recesses, it is possible to restrict the rotation of the supply reel 25 and the take-up reel 26. It should be noted that the insertion member 52 can be easily removed by pulling a tab 52*a*.

Packing Member

Figure 31:
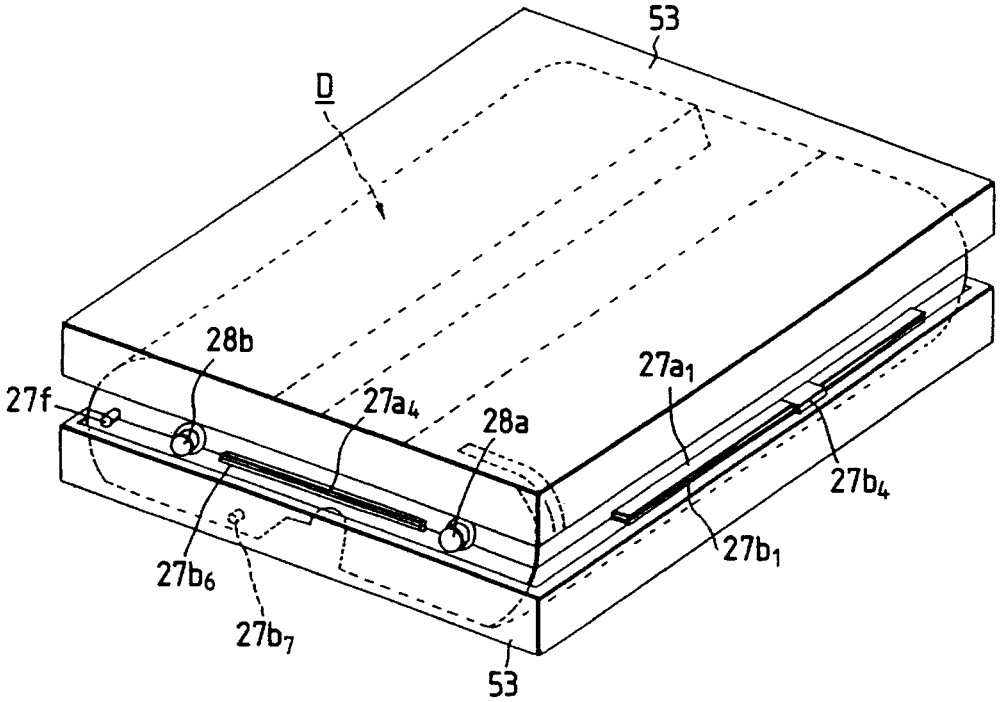
FIG. 31 is an explanation view showing another example for packing member.

While in the previous example, the packing member 33 is loaded from the side of the ink sheet cartridge D, as shown in FIG. 10, the packing member 53 can be loaded from an upper or lower side of the ink sheet cartridge d, as shown in FIG. 31, in such a manner of getting rid of the bearings 28*a*, 28*b* and the weld zones $27a_1$, $27b_1$ and $27a_4$, $27b_6$ and contained in an external box, so that the bearings 28*a*, 28*b* can be protected from impacts.

Cartridge and Identification of n Value

In the previous example, in order to detect the presence or absence of the cartridge D, the size of ink sheet, and the recording n value, the cartridge D is provided with the identification pieces $27i_1$, $27i_2$ and $27i_3$, which press the microswitch 29 securely due to elastic deformation at thinner wall portions, whereas the identification pieces $27i_1$, $27i_2$, $27i_3$ may be constituted to be deformable by connecting with spring members, rather than the thinner wall portions.

Also, the detection means can be a reflection-type sensor, for example, rather than the microswitch 29.

Moreover, the identification pieces are not limited to three pieces, but changeable as appropriate, depending on the selected number of recording n value. And the constitution of identification means is not also limited to the identification pieces $27i_1$, $27i_2$, $27i_3$ as in the previous example, but can take the arc or projecting shape in accordance with the detection means.

Moreover, the platen motor 39 and the ink sheet motor 41*b* for conveying recording sheet 1 and ink sheet 2 in accordance with the recording n value are stepping motors in the previous example, but can be DC or servo motors.

It should be noted that in the example as above described, the reel and the reel shaft are separately formed, but even if the reel and the reel shaft are integrated, for example, in such a constitution that a gear for directly driving the reel is provided on an end portion of the take-up reel, the effects of the present invention can be fulfilled as long as the strength of the reel itself has the relation as described in the previous example.

As described above, according to the present invention, it is possible to provided an ink sheet cartridge and a recording apparatus using the cartridge in which the strengths of the take-up reel and the supply reel within the ink sheet cartridge are made optimum.

We claim:

1. An ink sheet cartridge mountable onto a recording apparatus, said cartridge comprising:

a supply reel around which an ink sheet is wound;

a take-up reel for winding said ink sheet supplied from said supply reel; and a frame body for holding said supply reel and said take-up reel;

wherein a shaft member of said take-up reel is formed of a material having a mechanical strength greater than that of a material forming a shaft member of said supply reel.

2. An ink sheet cartridge according to claim 1, wherein the flexural rigidity of said shaft member of said take-up reel is larger than that of said shaft member of said supply reel.

3. An ink sheet cartridge according to claim 1, wherein an outer diameter of said shaft member of said take-up reel is larger than that of said shaft member of said supply reel.

4. An ink sheet cartridge according to claim 1, wherein said ink sheet cartridge is used in a facsimile apparatus having a receiving mechanism for receiving image information through an external communication line.

5. An ink sheet cartridge according to claim 1, wherein the flexural rigidity of said shaft member of said supply reel is at least $0.5\times10^6$ kgmm$^2$ and no more than $2.5\times10^6$ kgmm$^2$.

6. An ink sheet cartridge according to claim 1, wherein the flexural rigidity of said shaft member of said take-up reel is at least $3.0\times10^7$ kgmm$^2$ and no more than $5.5\times10^7$ kgmm$^2$.

7. A recording apparatus comprising:

recording means for recording with the application of energy to an ink sheet contained within an ink sheet cartridge in accordance with an image signal; and a mounting portion for mounting said ink sheet cartridge, said cartridge having a supply reel around which said ink sheet is wound, a take-up reel for winding said ink sheet supplied from said supply reel, and a frame body for holding said supply reel and said take-up reel, wherein a shaft member of said take-up reel is formed of a material having a mechanical strength greater than that of a material forming a shaft member of said supply reel.

8. A recording apparatus according to claim 7, wherein the flexural rigidity of said shaft member of said take-up reel is larger than that of said shaft member of said supply reel.

9. A recording apparatus according to claim 7, wherein an outer diameter of said shaft member of said take-up reel is larger than that of said shaft member of said supply reel.

10. A recording apparatus according to claim 7, wherein said recording apparatus is provided with original reading means for reading an original.

11. A recording apparatus according to claim 10, wherein said recording apparatus is a facsimile equipment.

12. A recording apparatus according to claim 7, wherein the flexural rigidity of said shaft member of said supply reel is at least $0.5\times10^6$ kgmm$^2$ and no more than $2.5\times10^6$ kgmm$^2$.

13. A recording apparatus according to claim 7, wherein the flexural rigidity of said shaft member of said take-up reel is at least $3.0\times10^7$ kgmm$^2$ and no more than $5.5\times10^7$ kgmm$^2$.

14. A recording apparatus comprising:

recording means for recording onto a recording medium with the application of energy to an ink sheet contained within an ink sheet cartridge in accordance with an image signal;

a mounting portion for mounting said ink sheet cartridge, said cartridge having a supply reel around which said ink sheet is wound, a take-up reel for winding said ink sheet supplied from said supply reel, and a frame body for holding said supply reel and said take-up reel, wherein a shaft member of said take-up reel is formed of a material having a mechanical strength greater than that of a material forming a shaft member of said supply reel; and conveying means for conveying said recording medium in a direction opposite to the conveying direction of said ink sheet.

15. A recording apparatus according to claim 14, wherein the conveying speed of said ink sheet is slower than that of said recording medium.

16. A recording apparatus according to claim 14, wherein said recording apparatus winds said ink sheet by 1/n lines, where n is positive integers, around said take-up reel for each recording of one line onto said recording medium.

17. A recording apparatus according to claim 14, wherein the flexural rigidity of said shaft member of said take-up reel is larger than that of said shaft member of said supply reel.

18. A recording apparatus according to claim 14, wherein an outer diameter of said shaft member of said take-up reel is larger than that of said shaft member of said supply reel.

19. A recording apparatus according to claim 14, wherein said recording apparatus is provided with original reading means for reading an original.

20. A recording apparatus according to claim 19, wherein said recording apparatus is a facsimile equipment.

21. A recording apparatus according to claim 14, wherein the flexural rigidity of said shaft member of said supply reel is at least $0.5\times10^6$ kgmm$^2$ and no more than $2.5\times10^6$ kgmm$^2$.

22. A recording apparatus according to claim 14, wherein the flexural rigidity of said shaft member of said take-up reel is at least $3.0\times10^7$ kgmm$^2$ and no more than $5.5\times10^7$ kgmm$^2$.

23. An ink sheet cartridge mountable on a recording apparatus, said cartridge comprising:

a supply reel around which an ink sheet is wound;

a take-up reel for winding said ink sheet supplied from said supply reel; and a frame body for holding said supply reel and said take-up reel;

wherein a shaft member of said take-up reel is formed of a material having a mechanical strength greater than that of a material forming a shaft member of said supply reel, and said supply reel is lighter than said take-up reel.

24. An ink sheet cartridge according to claim 23, wherein the flexural rigidity of said shaft member of said take-up reel is larger than that of said shaft member of said supply reel.

25. An ink sheet cartridge according to claim 23, wherein said ink sheet cartridge is used in a facsimile apparatus having a receiving mechanism for receiving image information through an external communication line.

26. An ink sheet cartridge according to claim 23, wherein the flexural rigidity of said shaft member of said supply reel is at least $0.5\times10^6$ kgmm$^2$ and no more than $2.5\times10^6$ kgmm$^2$.

27. An ink sheet cartridge according to claim 23, wherein the flexural rigidity of said shaft member of said take-up reel is at least $3.0\times10^7$ kgmm$^2$ and no more than $5.5\times10^7$ kgmm$^2$.

28. A recording apparatus comprising:

recording means for recording with the application of energy to an ink sheet contained within an ink sheet cartridge in accordance with an image signal; and a mounting portion for mounting said ink sheet cartridge, said cartridge having a supply reel around which said ink sheet is wound, a take-up reel for winding said ink sheet supplied from said supply reel, and a frame body for holding said supply reel and said take-up reel, wherein a shaft member of said take-up reel is formed of a material having a mechanical strength greater than that of a material forming a shaft member of said supply reel, and said supply reel is lighter than said take-up reel.

29. A recording apparatus according to claim 28, wherein the flexural rigidity of said shaft member of said take-up reel is larger than that of said shaft member of said supply reel.

30. A recording apparatus according to claim 28, wherein said recording apparatus is provided with original reading means for reading an original.

31. A recording apparatus according to claim 30, wherein said recording apparatus is a facsimile equipment.

32. A recording apparatus according to claim 28, wherein the flexural rigidity of said shaft member of said supply reel is at least $0.5\times10^6$ kgmm$^2$ and no more than $2.5\times10^6$ kgmm$^2$.

33. A recording apparatus according to claim 28, wherein the flexural rigidity of said shaft member of said take-up reel is at least $3.0\times10^7$ kgmm$^2$ and no more than $5.5\times10^7$ kgmm$^2$.

34. A recording apparatus comprising:

recording means for recording onto a recording medium with the application of energy to an ink sheet contained within an ink sheet cartridge in accordance with an image signal;

a mounting portion for mounting said ink sheet cartridge, said cartridge having a supply reel around which said ink sheet is wound, a take-up reel for winding said ink sheet supplied from said supply reel, and a frame body for holding said supply reel and said take-up reel, wherein a shaft member of said take-up reel is formed of a material having a mechanical strength greater than that of a material forming a shaft member of said supply reel, and said supply reel is lighter than said take-up reel; and conveying means for conveying said recording medium in a direction opposite to the conveying direction of said ink sheet.

35. A recording apparatus according to claim 34, wherein the conveying speed of said ink sheet is slower than that of said recording medium.

36. A recording apparatus according to claim 34, wherein said recording apparatus winds said ink sheet by 1/n lines, where n is positive integer, around said take-up reel for each recording of one line onto said recording medium.

37. A recording apparatus according to claim 34, wherein the flexural rigidity of said shaft member of said take-up reel is larger than that of said shaft member of said supply reel.

38. A recording apparatus according to claim 34, wherein said recording apparatus is providing with original reading means for reading an original.

39. A recording apparatus according to claim 38, wherein said recording apparatus is a facsimile equipment.

40. A recording apparatus according to claim 34, wherein the flexural rigidity of said shaft member of said supply reel is at least $0.5\times10^6$ kgmm$^2$ and no more than $2.5\times10^6$ kgmm$^2$.

41. A recording apparatus according to claim 34, wherein the flexural rigidity of said shaft member of said take-up reel is at least $3.0\times10^7$ kgmm$^2$ and no more than $5.5\times10^7$ kgmm$^2$.

42. An ink sheet cartridge according to one of claim 1 or claim 23, wherein the ink sheet cartridge is mounted on an ink sheet cartridge mounting portion of the recording apparatus so that the supply reel is closer to the rotation center than the winding reel.

43. A recording apparatus according to one of claim 7, claim 14, claim 28 or claim 34, wherein the mounting portion of the recording apparatus is rotatable at a rotation center and the mounting portion mounts the ink sheet cartridge so that the supply reel is closer to the rotation center than the winding reel.

44. An apparatus according to one of claim 1, claim 7, claim 14, claim 16, claim 23, claim 28 or claim 34, wherein the recording apparatus records in a state that the conveying speed of the recording medium is slower than that of the ink sheet.

45. A recording apparatus comprising:

recording means for recording with the application of energy to an ink sheet contained within an ink sheet cartridge in accordance with an image signal, said cartridge having a supply reel around which said ink sheet is wound, a take-up reel for winding said ink sheet supplied from said supply reel, and a frame body for holding said supply reel and said take-up reel; and a mounting portion for mounting said ink sheet cartridge, said mounting portion being rotatable at a rotation center and mounting said ink sheet cartridge so that the supply reel is closer to the rotation center than the winding reel, wherein a shaft member of said take-up reel is formed of a material having a mechanical strength greater than that of a material forming a shaft member of said supply reel.

* * * * *

UNITED STATES PATENT AND TRADEMARK OFFICE

CERTIFICATE OF CORRECTION

PATENT NO. : 5,536,093

DATED : July 16, 1996

INVENTOR(S) : Tomoda et al.

It is certified that error appears in the above-indentified patent and that said Letters Patent is hereby corrected as shown below:

COLUMN 3:

Line 12, "are views" should read --are--.

COLUMN 4:

Line 39, "orginal" should read --original--.

COLUMN 6:

Line 61, "tile" should read --the--.

COLUMN 7:

Line 7, "openigns" should read --openings--.

COLUMN 8:

Line 19, "the the" should read --the--.

COLUMN 14:

Line 67, "unlocking" should read --unlocking.--.

COLUMN 15:

Line 9, "directions," should read --directions.--.

UNITED STATES PATENT AND TRADEMARK OFFICE

CERTIFICATE OF CORRECTION

PATENT NO. : 5,536,093

DATED : July 16, 1996

INVENTOR(S) : Tomoda et al.

It is certified that error appears in the above-indentified patent and that said Letters Patent is hereby corrected as shown below:

COLUMN 16:

Line 34, "bearigns" should read --bearings--, and "reapective" should read --respective--.

COLUMN 19:

Line 56, "driving" should read --in driving--.

COLUMN 21:

Line 50, "cartridge" should read --cartridge D--.

COLUMN 22:

Line 14, "decision" should read --a decision--;
Line 31, "t:he" should read --the--; and
Line 33, "recordnig" should read --recording--.

COLUMN 24:

Line 51, "mebmer" should read --member--.

COLUMN 25:

Line 55, "provided" should read --provide--.

UNITED STATES PATENT AND TRADEMARK OFFICE

CERTIFICATE OF CORRECTION

PATENT NO. : 5,536,093 Page 3 of 3

DATED : July 16, 1996

INVENTOR(S) : Tomoda et al.

It is certified that error appears in the above-indentified patent and that said Letters Patent is hereby corrected as shown below:

COLUMN 27:

Line 6, after "is" insert --a--, and "integers," should read --integer,--; and

Line 49, "5.5 x $10^{7\,kgmm2}$" should read

--5.5 x $10^7$ $kgmm^2$--.

Signed and Sealed this

Twenty-sixth Day of November 1996

Attest:

Bruce Lehman

BRUCE LEHMAN

Attesting Officer

Commissioner of Patents and Trademarks